US008702189B2

(12) United States Patent
Watanabe

(10) Patent No.: US 8,702,189 B2
(45) Date of Patent: Apr. 22, 2014

(54) LIQUID EJECTION APPARATUS, CONTROL APPARATUS, AND STORAGE MEDIUM STORING PROGRAM

(75) Inventor: Junji Watanabe, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 291 days.

(21) Appl. No.: 13/074,941

(22) Filed: Mar. 29, 2011

(65) Prior Publication Data

US 2011/0261096 A1 Oct. 27, 2011

(30) Foreign Application Priority Data

Mar. 29, 2010 (JP) ..... 2010-075693
Mar. 29, 2010 (JP) ..... 2010-075694

(51) Int. Cl.
*B41J 29/38* (2006.01)
*B41J 2/165* (2006.01)

(52) U.S. Cl.
USPC ..... 347/9; 347/22; 347/35

(58) Field of Classification Search
USPC ..... 347/5, 6, 9, 12–14, 19
See application file for complete search history.

(56) References Cited

U.S. PATENT DOCUMENTS 5,557,306 A * 9/1996 Fukushima et al. ..... 347/33
6,158,839 A * 12/2000 Fukushima et al. ..... 347/33
6,402,292 B1 6/2002 Ninomiya
6,974,201 B2 * 12/2005 Kanemura ..... 347/23
7,165,832 B2 * 1/2007 Kojima ..... 347/74
7,452,051 B2 * 11/2008 Mihara et al. ..... 347/22
7,562,961 B2 * 7/2009 Inoue ..... 347/35
7,690,749 B2 * 4/2010 Kachi ..... 347/19
8,052,246 B2 * 11/2011 Yamamoto ..... 347/22
8,287,084 B2 * 10/2012 Ito ..... 347/23
8,506,044 B2 * 8/2013 Takeda et al. ..... 347/33
2004/0090487 A1 5/2004 Kanemura (Continued)

FOREIGN PATENT DOCUMENTS

CN 101352968 A 1/2009
CN 101444996 A 6/2009

(Continued)

OTHER PUBLICATIONS

Japan Patent Office, Notification of Reason for Refusal for Japanese Patent Application No. 2010-075693, dispatched Jan. 24, 2012.

(Continued)

*Primary Examiner* — Laura Martin
*Assistant Examiner* — Jeremy Bishop
(74) *Attorney, Agent, or Firm* — Baker Botts L.L.P.

(57) ABSTRACT

A liquid ejection apparatus including: a head having an ejection face having ejection openings for ejecting liquid onto a recording medium; a convey belt that has a support region for supporting the recording medium and a preliminary ejection region onto which the liquid is ejected in preliminary ejection and that conveys the recording medium in a conveying direction, wherein the preliminary ejection is ejection not contributing to image recording; and a controller which controls the head and the convey belt based on preliminary ejection data such that, until a specific length of time has passed from the ejection of the liquid onto the preliminary ejection region, liquid is landed on a position in the preliminary ejection region in current ejection, which position does not overlap at least one position of the liquid landed after the ejection of the liquid.

17 Claims, 11 Drawing Sheets

(56) References Cited

U.S. PATENT DOCUMENTS

| | | | |
|---|---|---|---|
| 2004/0113973 | A1 | 6/2004 | Nakashima |
| 2004/0119777 | A1 | 6/2004 | Nakashima et al. |
| 2004/0189737 | A1 | 9/2004 | Nakashima |
| 2004/0263560 | A1 | 12/2004 | Nakashima |
| 2005/0078145 | A1 | 4/2005 | Inoue |
| 2006/0164459 | A1 | 7/2006 | Mihara et al. |
| 2009/0141070 | A1 | 6/2009 | Yamamoto |
| 2009/0244148 | A1 | 10/2009 | Mitsuhashi et al. |
| 2010/0053254 | A1 | 3/2010 | Ito |

FOREIGN PATENT DOCUMENTS

| | | | |
|---|---|---|---|
| CN | 101665023 | A | 3/2010 |
| JP | H09-109377 | A | 4/1997 |
| JP | H11-198395 | A | 7/1999 |
| JP | 2004-168036 | A | 6/2004 |
| JP | 2006-116808 | A | 5/2006 |
| JP | 2006-198997 | A | 8/2006 |
| JP | 2006-239871 | A | 9/2006 |
| JP | 2006-272554 | A | 10/2006 |

OTHER PUBLICATIONS

Japan Patent Office, Notification of Reason for Refusal for Japanese Patent Application No. 2010-075694, dispatched Jan. 24, 2012.

European Patent Office, Extended European Search Report for European Patent Application No. 11160065.6, dated Aug. 22, 2011.

State Intellectual Property Office of the People'S Republic of China, Notification of First Office Action for Chinese Patent Application No. 201110082439.X, mailed Jul. 1, 2013.

* cited by examiner

LIQUID EJECTION APPARATUS, CONTROL APPARATUS, AND STORAGE MEDIUM STORING PROGRAM

CROSS REFERENCE TO RELATED APPLICATION

The present application claims priority from Japanese Patent Application Nos. 2010-075693 filed on Mar. 29, 2010, and 2010-075694 filed on Mar. 29, 2010, the disclosure of which is herein incorporated by reference in its entirety.

BACKGROUND OF THE INVENTION

1. Field of the Invention

The present invention relates to a liquid ejection apparatus configured to eject liquid such as ink, and to a control apparatus and a storage medium storing a program used in the liquid ejection apparatus.

2. Description of the Related Art

There is known a liquid ejection apparatus such as an ink-jet printer configured to perform preliminary ejection in order to remove or restrain thickening of ink near ejection openings of a head. The preliminary ejection is ejection not contributing to image recording and performed onto a cap, a recording medium, a convey belt, and so on.

Where the preliminary ejection is performed onto the cap, a time for moving the head to a capping position is required, making it difficult to perform high-speed recording. Further, an area for providing the cap is required, which disadvantageously upsizes an apparatus. Where the preliminary ejection is performed onto a recording medium for recording, a recording quality is deteriorated by ink landed or attached on the recording medium. Where the preliminary ejection is performed onto a recording medium not for recording, the recording medium not for recording is required, which leads to higher cost. To solve these problems, there is known a technique for providing a preliminary ejection region on a face of a convey belt and performing the preliminary ejection on this region.

As the preliminary ejection, there is also known a technique for ejecting treatment liquid (reactive liquid) by a head onto a recording medium before and/or after the ink is landed on the recording medium.

SUMMARY OF THE INVENTION

However, where the preliminary ejection is performed on the preliminary ejection region on the face of the convey belt as in the above-described technique, the following problems may arise. That is, where ink is further ejected onto the preliminary ejection region at positions on which ink has already been landed on the face of the convey belt in an undried state, a collision between inks may cause flying of the ink and upsizing of ink droplets on the face of the convey belt. The flown ink may cause a stain by being attached to an ejection face of the head, a support region provided on the face of the sheet-convey belt for supporting the recording medium, or the recording medium on the support region. In addition, the upsized ink droplet may be attached to the ejection face of the head or may be moved to an upstream side in a conveying direction by an inertial force (i.e., a force toward an upstream side in the conveying direction) generated by rotation of the convey belt and thereby attached to the support region or the recording medium located on the support region.

This invention has been developed in view of the above-described situations, and it is an object of the present invention to provide a liquid ejection apparatus, a control apparatus, and a storage medium storing a program which can restrain flying of liquid ejected onto a preliminary ejection region provided on a face of a convey belt and can restrain upsizing of a liquid droplet on the face of the convey belt.

The object indicated above may be achieved according to the present invention which provides a liquid ejection apparatus comprising: at least one head each having an ejection face which has a plurality of ejection openings opened therein for ejecting liquid onto a recording medium; a convey belt which has a support region and at least one preliminary ejection region each provided on a face of the convey belt and which is configured to convey the recording medium in a conveying direction parallel to the ejection face by moving the face of the convey belt in a state in which the face faces the ejection face, wherein the support region is a region for supporting the recording medium, wherein the preliminary ejection region is a region onto which the liquid is ejected from the ejection openings in preliminary ejection, and wherein the preliminary ejection is ejection not contributing to image recording; and a controller configured to control the head and the convey belt; wherein the controller is configured to control the head and the convey belt on the basis of preliminary ejection data for the preliminary ejection such that, until a specific length of time has passed from the ejection of the liquid from the ejection openings onto the preliminary ejection region, liquid is landed on a position in the preliminary ejection region in current ejection, which position does not overlap any of at least one position of the liquid landed after the ejection of the liquid from which the specific length of time has passed.

The object indicated above may also be achieved according to the present invention which provides a control apparatus used for a liquid ejection apparatus comprising: at least one head each having an ejection face which has a plurality of ejection openings opened therein for ejecting liquid onto a recording medium; and a convey belt which has a support region and at least one preliminary ejection region each provided on a face of the convey belt and which is configured to convey the recording medium in a conveying direction parallel to the ejection face by moving the face of the convey belt in a state in which the face faces the ejection face, wherein the support region is a region for supporting the recording medium, wherein the preliminary ejection region is a region onto which the liquid is ejected from the ejection openings in preliminary ejection, and wherein the preliminary ejection is ejection not contributing to image recording, the control apparatus comprising a controller configured to control the head and the convey belt, wherein the controller is configured to control the head and the convey belt on the basis of preliminary ejection data for the preliminary ejection such that, until a specific length of time has passed from the ejection of the liquid from the ejection openings onto the preliminary ejection region, liquid is landed on a position in the preliminary ejection region in current ejection, which position does not overlap any of at least one position of the liquid landed after the ejection of the liquid from which the specific length of time has passed.

The object indicated above may also be achieved according to the present invention which provides a storage medium storing a program used for a liquid ejection apparatus, the apparatus comprising: at least one head each having an ejection face which has a plurality of ejection openings opened therein for ejecting liquid onto a recording medium; and a convey belt which has a support region and at least one preliminary ejection region each provided on a face of the convey belt and which is configured to convey the recording medium in a conveying direction parallel to the ejection face by moving the face of the convey belt in a state in which the face faces the ejection face, wherein the support region is a region for supporting the recording medium, wherein the preliminary ejection region is a region onto which the liquid is ejected from the ejection openings in preliminary ejection, and wherein the preliminary ejection is ejection not contributing to image recording, wherein the program is operable to control the head and the convey belt on the basis of preliminary ejection data for the preliminary ejection such that, until a specific length of time has passed from the ejection of the liquid from the ejection openings onto the preliminary ejection region, liquid is landed on a position in the preliminary ejection region in current ejection, which position does not overlap any of at least one position of the liquid landed after the ejection of the liquid from which the specific length of time has passed.

In each configuration as described above, a collision between the liquids on the preliminary ejection region is prevented. Accordingly, it is possible to restrain flying of the liquid ejected onto the preliminary ejection region and upsizing of a liquid droplet on the face of the convey belt.

It is noted that the present invention may be embodied in a configuration below. That is, the object indicated above may also be achieved according to the present invention which provides a liquid ejection apparatus comprising:

a first head having a first ejection face having a plurality of first ejection openings formed therein for ejecting recording liquid onto a recording medium;

a second head having a second ejection face having a plurality of second ejection openings formed therein for ejecting transparent treatment liquid onto the recording medium;

a convey belt which has a support region and at least one preliminary ejection region each provided on a face of the convey belt and which is configured to convey the recording medium in the conveying direction parallel to the first ejection face and the second ejection face by moving the face of the convey belt in a state in which the face faces the first ejection face and the second ejection face, wherein the support region is a region for supporting the recording medium, wherein the preliminary ejection region is a region onto which the recording liquid and the treatment liquid are ejected from the plurality of first ejection openings and the plurality of second ejection openings in preliminary ejection, and wherein the preliminary ejection is ejection not contributing to image recording; and a controller configured to control the head and the convey belt;

wherein the controller is configured to control the first head, the second head, and the convey belt on the basis of the preliminary ejection data such that the recording liquid is ejected from the plurality of first ejection openings and landed on the preliminary ejection region, and thereafter the treatment liquid is ejected to be landed on a position in the preliminary ejection region, which position is located on an upstream side of a position on which the recording liquid has been landed, in the conveying direction.

In the liquid ejection apparatus constructed as described above, it is possible to restrain that the recording liquid ejected onto the preliminary ejection region provided on the face of the convey belt is attached on the support region or the recording medium on the support region.

BRIEF DESCRIPTION OF THE DRAWINGS

The objects, features, advantages, and technical and industrial significance of the present invention will be better understood by reading the following detailed description of embodiments of the invention, when considered in connection with the accompanying drawings, in which.

DETAILED DESCRIPTION OF THE EMBODIMENTS

Hereinafter, there will be described embodiments of the present invention by reference to the drawings.

Figure 1:
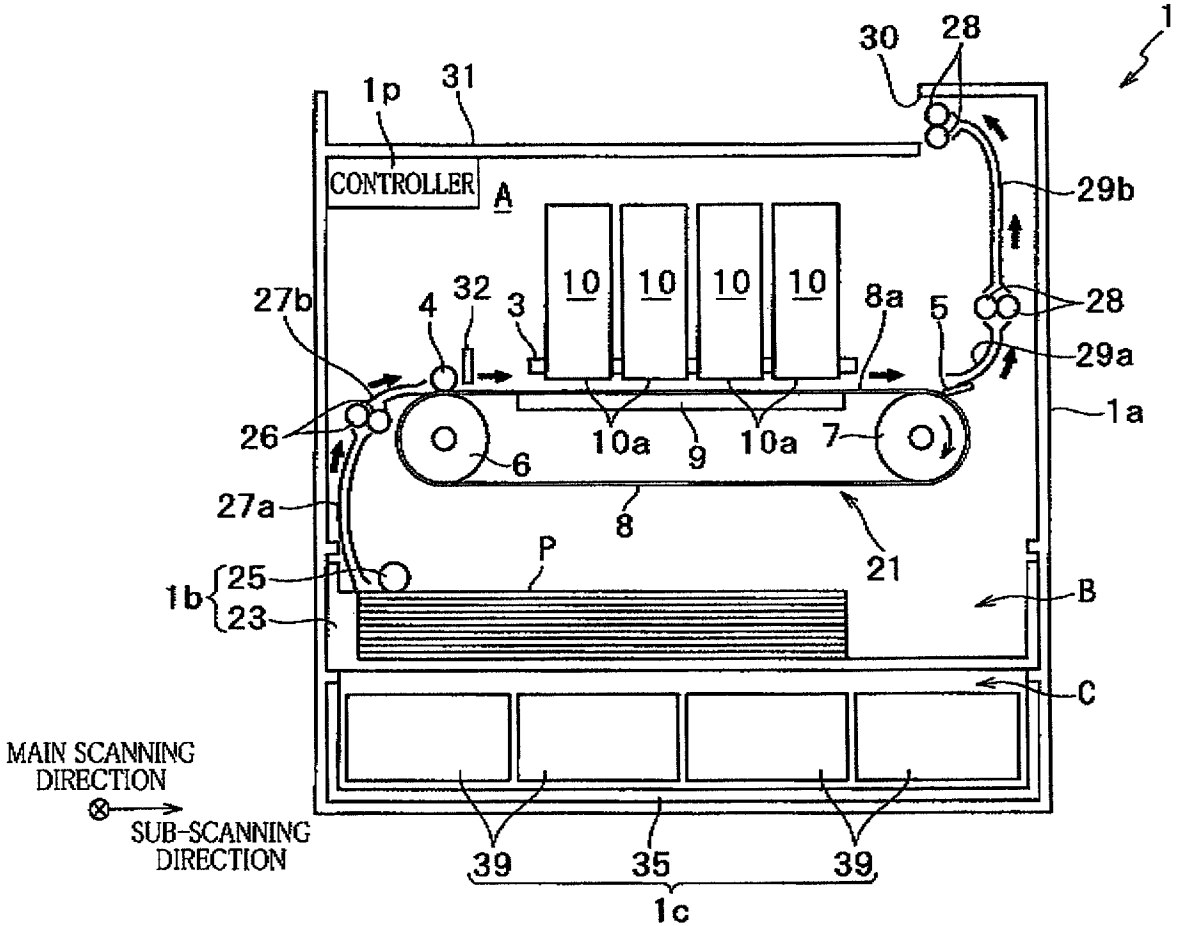
FIG. 1 is a side view generally showing an internal construction of an ink-jet printer as a first embodiment of a liquid ejection apparatus to which the present invention is applied.

First, there will be explained an overall construction of an ink-jet printer 1 as a first embodiment of a liquid ejection apparatus to which the present invention is applied, with reference to FIG. 1.

The printer 1 includes a casing 1*a* having a rectangular parallelepiped shape. A sheet-discharge portion 31 is provided at an upper portion of a top plate of the casing 1*a*. An inner space of the casing 1*a* is divided into spaces A, B, and C in order from an upper side thereof. In the spaces A, B is formed a sheet conveying path which is continuous to the sheet-discharge portion 31. In the space C, four cartridges 39 are accommodated. Each of the four cartridges 39 can store recording liquid such as an ink to be supplied to a corresponding one of four ink-jet heads 10 (each as one example of a first head), that is, each cartridge 39 functions as an ink supply source for the corresponding ink-jet head 10.

In the space A, there are arranged the four heads 10, a sheet-convey unit 21 for conveying or feeding a recording medium such as a sheet P, a guide unit for guiding the sheet P, and so on. In an upper portion of the space A, there is disposed a controller 1*p* configured to control operations of components of the printer 1 to control an overall operation of the printer 1.

The controller 1*p* controls a recording operation on the basis of image data supplied or transmitted from an external device. Examples of the recording operation include a conveying operation for conveying the sheet P, an ejecting operation for ejecting the ink used for image recording or the ink used for preliminary ejection in synchronization with the conveying operation, and so on. The control of the recording operation including the preliminary ejection will be explained in detail later.

The sheet-convey unit 21 includes: (a) belt rollers 6, 7; (b) an endless sheet-convey belt 8 wound around the rollers 6, 7; (c) a nip roller 4 and a peeling plate 5 disposed outside the sheet-convey belt 8; (d) a platen 9 disposed inside the sheet-convey belt 8; and so on. The belt roller 7 is a drive roller which is rotated in a clockwise direction in FIG. 1 by a drive power of a sheet-convey motor 121 (see FIG. 6). The rotation of the belt roller 7 rotates or circulates the sheet-convey belt 8 in a direction indicated by bold arrow in FIG. 1. The belt roller 6 is a driven roller which is rotated in the clockwise direction in FIG. 1 in accordance with the rotation of the sheet-convey belt 8. The nip roller 4 is disposed so as to face the belt roller 6. When the sheet P is supplied from an upstream side of the nip roller 4 in a conveying direction in which the sheet P is conveyed, the nip roller 4 presses the sheet P onto a support face 8*a* as an outer circumferential face of the sheet-convey belt 8. The sheet P is then fed toward the belt roller 7 with the rotation of the sheet-convey belt 8 while supported on the support face 8*a*. The peeling plate 5 is disposed so as to face the belt roller 7. The peeling plate 5 peels the sheet P from the support face 8*a* to guide the peeled sheet P toward a downstream side in the conveying direction. The platen 9 is disposed so as to face the four heads 10 and supports an inner circumferential face of an upper portion of the sheet-convey belt 8 from the inside thereof.

The construction of the support face 8*a* of the sheet-convey belt 8 will be explained in greater detail later with reference to FIG. 5.

Each of the heads 10 is a line head having a generally rectangular parallelepiped shape elongated in a main scanning direction in which each head reciprocates. Each head 10 has a lower face functioning as a first ejection face 10*a* having a multiplicity of ejection openings 14*a* formed therein (see FIGS. 3 and 4). When image recording (image forming) is performed, each head 10 ejects an ink of a corresponding one of four colors, namely, black (K), magenta (M), cyan (C), and yellow (Y), from the corresponding ejection face 10*a*. The heads 10 are supported by the casing 1*a* via a head holder 3 so as to be arranged at predetermined pitches in a sub-scanning direction which is perpendicular to the main scanning direction. The head holder 3 holds the heads 10 such that the ejection faces 10*a* face the support face 8*a* of the upper portion of the sheet-convey belt 8 so as to provide a specific space suitable for the recording between the support face 8*a* and the ejection faces 10*a*. A specific construction of each head 10 will be explained in greater detail later.

The guide unit includes an upstream guide portion and a downstream guide portion arranged respectively on opposite sides of the sheet-convey unit 21. The upstream guide portion includes two guides 27*a*, 27*b* and a pair of sheet-convey rollers 26 and connects between the sheet-convey unit 21 and a sheet-supply unit 1*b* which will be described below. The downstream guide portion includes two guides 29*a*, 29*b* and two pairs of sheet-convey rollers 28 and connects between the sheet-convey unit 21 and the sheet-discharge portion 31.

In the space B, the sheet-supply unit 1*b* is disposed so as to be attachable to and detachable from the casing 1*a*. The sheet-supply unit 1*b* includes a sheet-supply tray 23 and a sheet-supply roller 25. The sheet-supply tray 23 has a box-like shape opening upward and accommodates a plurality of sheets P of various sizes. The sheet-supply roller 25 supplies, to the upstream guide portion, an uppermost one of the sheets P accommodated in the sheet-supply tray 23.

As described above, in the spaces A, B is formed the sheet conveying path extending from the sheet-supply unit 1*b* to the sheet-discharge portion 31 via the sheet-convey unit 21. The controller 1*p*, on the basis of a recording command received from the external device, drives a plurality of motors such as a sheet-supply motor 125 for the sheet-supply roller 25 (see FIG. 6), a sheet-convey motor 127 for the sheet-convey rollers of each guide portion (see FIG. 6), the sheet-convey motor 121 (see FIG. 6), and the like. The sheet P supplied from the sheet-supply tray 23 is fed or conveyed to the sheet-convey unit 21 by the sheet-convey rollers 26. When the sheet P passes through a position just under the heads 10, the heads 10 eject the inks of the respective four colors in order, to form a color image on the sheet P. In this recording operation, the preliminary ejection described below is also performed. The ejecting operation of the ink is performed on the basis of a detection signal outputted from a sheet sensor 32. The sheet P is then peeled by the peeling plate 5 and conveyed upward by the sheet-convey rollers 28. The sheet P is then discharged onto the sheet-discharge portion 31 through an opening 30.

Here, the sub-scanning direction is a direction parallel to the conveying direction in which the sheet P is conveyed by the sheet-convey unit 21, and the main scanning direction is a direction parallel to a horizontal plane and perpendicular to the sub-scanning direction.

In the space C, a cartridge unit 1*c* is disposed so as to be attachable to and detachable from the casing 1*a*. The cartridge unit 1*c* includes a tray 35 and the four cartridges 39 accommodated in the tray 35 so as to be arranged in a row. Each of the cartridges 39 stores the ink of the corresponding color. Each cartridge 39 supplies the ink to the corresponding head 10 via a tube, not shown.

Figure 2:
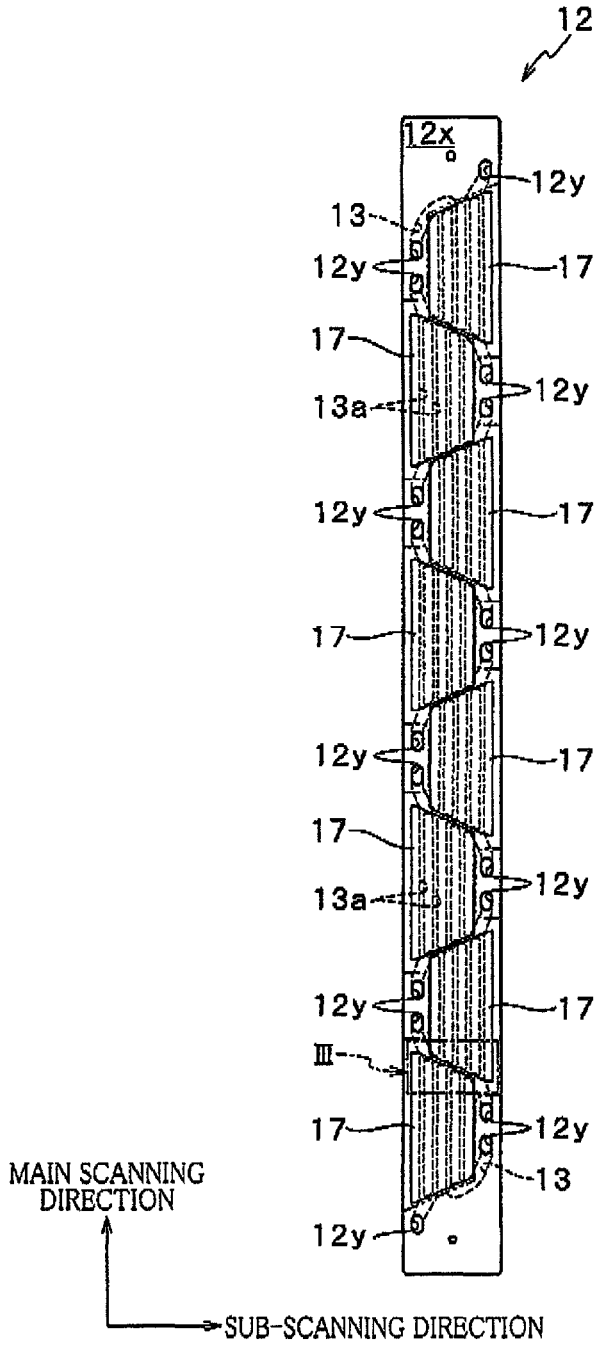
FIG. 2 is a plan view showing a channel unit and actuator units of the ink-jet head of the printer shown in FIG. 1.
Figure 3:
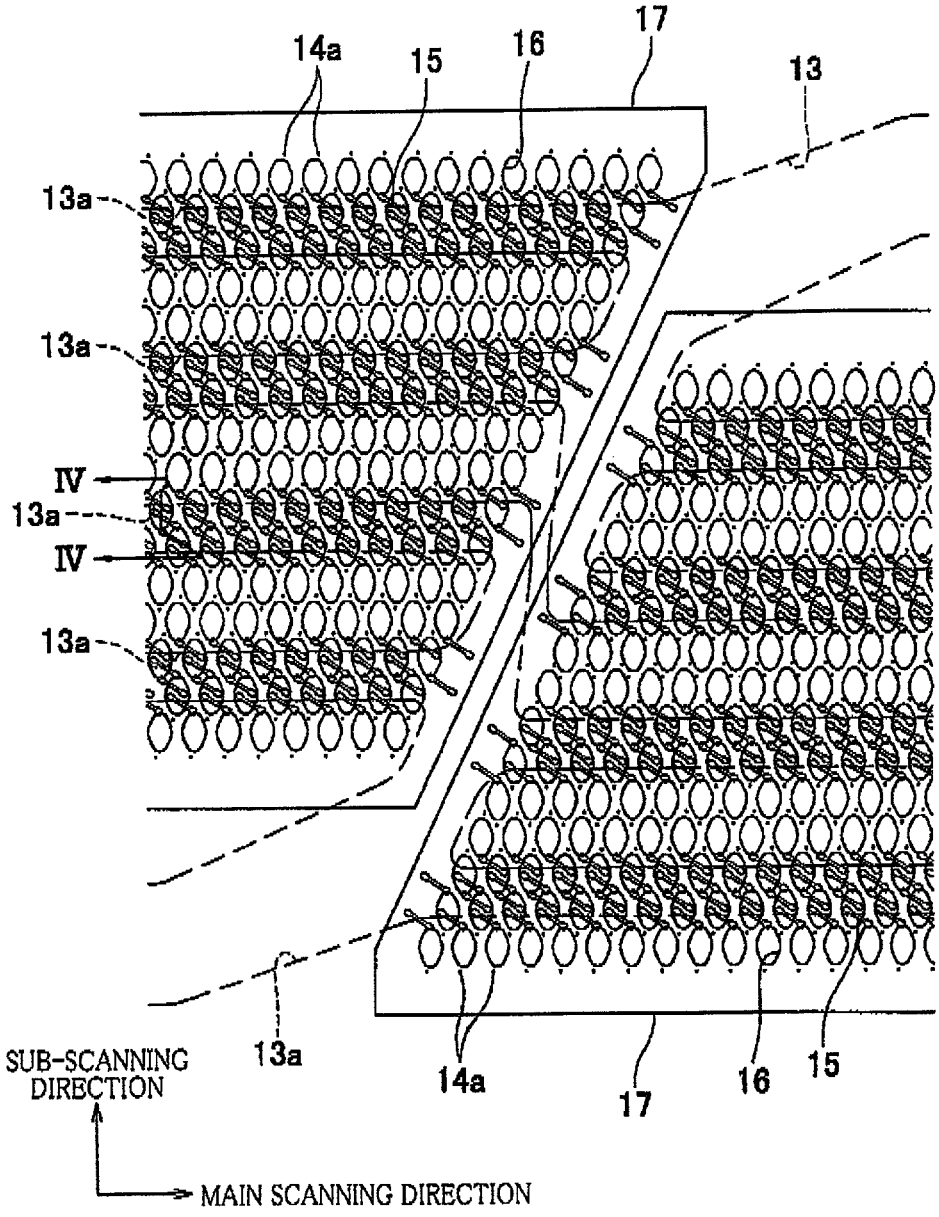
FIG. 3 is an enlarged view showing an area III enclosed with a one-dot chain line in FIG. 2.
Figure 4:
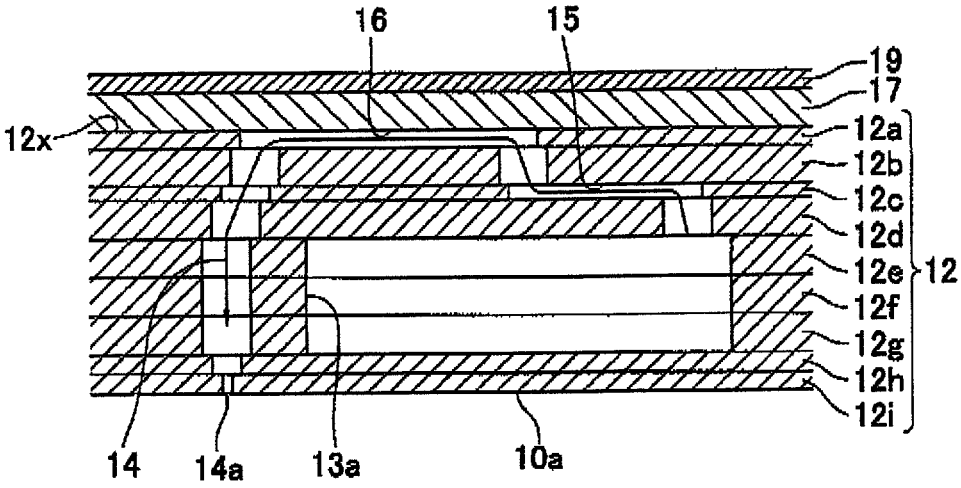
FIG. 4 is a cross-sectional view taken along a line IV-IV in FIG. 3.

There will be next explained the construction of the heads 10 with reference to FIGS. 2-4. Since the heads 10 have the same construction, the following explanation will be given for one of the heads 10 for the sake of simplicity. It is noted that, in FIG. 3, pressure chambers 16 and apertures 15 are indicated by solid lines for easier understanding purposes though these elements should be indicated by broken lines because the pressure chambers 16 and the apertures 15 are located under actuator units 17.

The head 10 includes: a reservoir unit, not shown, and a channel unit 12 which are stacked on each other in a vertical direction; the eight actuator units 17 (see FIG. 2) fixed to an upper face 12*x* of the channel unit 12; a flexible printed circuit (FPC) 19 (see FIG. 4) bonded to the actuator units 17; and so on. The reservoir unit has a channel formed therein which includes a reservoir for temporarily storing the ink supplied from the cartridge 39 (see FIG. 1). The channel unit 12 has channels formed therein each of which extends from a corresponding one of openings 12*y* (see FIG. 2) formed in the upper face 12*x* to a corresponding one of the ejection openings 14*a* formed in the lower face (the ejection face 10*a*). Each actuator unit 17 has piezoelectric actuators each for a corresponding one of the ejection openings 14*a*.

The reservoir unit has projecting portions and recessed portions formed on and in a lower face of the reservoir unit. The projecting portions are respectively bonded to areas of the upper face 12*x* of the channel unit 12, on which areas no actuator units 17 are disposed (i.e., areas enclosed with two-dot chain lines in FIG. 2, including the openings 12*y*). A distal end face of each of the projecting portions has an opening connected to the reservoir and facing a corresponding one of the openings 12*y* of the channel unit 12. As a result, the reservoir and individual channels 14 are communicated with each other via the openings. The recessed portions face the upper face 12*x* of the channel unit 12, faces of the respective actuator units 17, and a face of the FPC 19 with a small space therebetween.

The channel unit 12 is constituted by nine metal plates 12*a*, 12*b*, 12*c*, 12*d*, 12*e*, 12*f*, 12*g*, 12*h*, 12*i* (see FIG. 4) having generally the same size and stacked and bonded on one another. As shown in FIGS. 2, 3, and 4, channels of the channel unit 12 include: manifold channels 13 each having one of the openings 12*y* at one end thereof; sub-manifold channels 13*a* each branched from a corresponding one of the manifold channels 13; and the individual channels 14 each extending from an outlet of a corresponding one of the sub-manifold channels 13*a* to a corresponding one of the ejection openings 14*a* via a corresponding one of the pressure chambers 16. As shown in FIG. 4, each of the individual channels 14 is formed for one of the ejection openings 14*a* and includes a corresponding one of the apertures 15 each functioning as a restrictor for adjusting a channel resistance. Generally rhombus openings each for exposing a corresponding one of the pressure chambers 16 are arranged in matrix in the area of the upper face 12*x* on which each actuator unit 17 is bonded. Likewise, the ejection openings 14*a* are arranged in matrix in a similar pattern in each area of the lower face (i.e., the ejection face 10*a*), which area is opposed to a corresponding one of the areas of the upper face 12*x* on which the respective actuator units 17 are bonded.

As shown in FIG. 2, the actuator units 17 each having a trapezoid shape in plan view are arranged in two arrays in a staggered fashion on the upper face 12*x* of the channel unit 12. As shown in FIG. 3, each actuator unit 17 covers openings of a multiplicity of the pressure chambers 16 which are formed in the bonded area of the actuator unit 17. Though not shown in any figures, each actuator unit 17 includes: a plurality of piezoelectric layers expanding so as to straddle or expand across the pressure chambers 16; and electrodes sandwiching the piezoelectric layers in a thickness direction thereof. The electrodes include: individual electrodes provided for the respective pressure chambers 16; and a common electrode for the pressure chambers 16. The individual electrodes are formed on a face of an uppermost one of the piezoelectric layers.

The FPC 19 has wirings respectively corresponding to the electrodes of the actuator unit 17, and a driver IC, not shown, is mounted on a midway portion of each wiring. The FPC 19 is fixed at one end thereof to the actuator unit 17 and at the other end to a control board of the head 10, not shown, which is disposed above the reservoir unit. Under the control of the controller 1*p* (see FIG. 1), the FPC 19 transmits various drive signals outputted from the control board, to the driver IC, and transmits signals produced by the driver IC to the actuator units 17.

Figure 5:
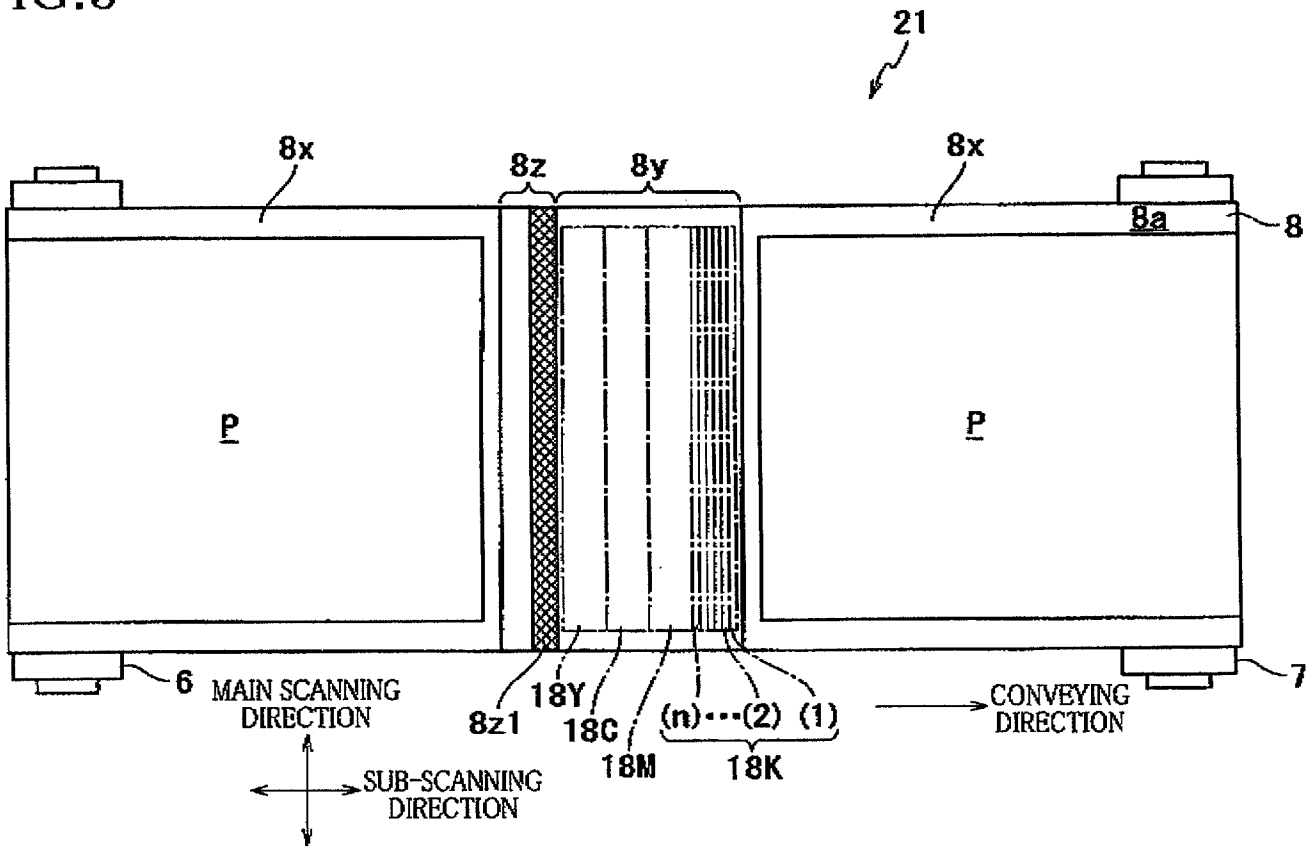
FIG. 5 is a plan view showing a sheet-convey belt of the printer shown in FIG. 1.

There will be next explained the construction of the support face 8*a* of the sheet-convey belt 8 with reference to FIG. 5.

As shown in FIG. 5, the support face 8*a* includes: support regions 8*x* for supporting the sheet P; a preliminary ejection region 8*y*; and a non-ejection region 8*z*. A width of each of the regions 8*x*, 8*y*, 8*z* (i.e., a length thereof in the main scanning direction) is the same as a width of the support face 8*a*.

The support regions 8*x* are provided so as to be spaced from one another along an entire length of the sheet-convey belt 8 in its circumferential direction. The support regions 8*x* are respectively disposed on upstream and downstream sides of a pair of the preliminary ejection region 8*y* and the non-ejection region 8*z* in the conveying direction. A length of each of the support regions 8*x* in the conveying direction is slightly longer than a length of a sheet P having the largest size among sheets P which can be used in this printer 1.

The preliminary ejection region 8*y* and the non-ejection region 8*z* are arranged between the support regions 8*x* in that order from a downstream side in the conveying direction, that is, the preliminary ejection region 8*y* is disposed on a downstream side of the non-ejection region 8*z*. The preliminary ejection region 8*y* and the non-ejection region 8*z* are also provided on the support face 8*a* of a lower portion of the sheet-convey belt 8 (i.e., a portion of the support face 8*a* which is opposite to the portion thereof shown in FIG. 5). The sheet P is not placed on the preliminary ejection region 8*y* and the non-ejection region 8*z*.

The preliminary ejection region 8*y* is a region onto which the inks are ejected in the preliminary ejection. The preliminary ejection region 8*y* has an ink repellent property and has ejection areas 18K, 18M, 18C, 18Y respectively corresponding to the four heads 10. The ejection areas 18K, 18M, 18C, 18Y are areas onto which the black, magenta, cyan, and yellow inks are respectively ejected. Each of the ejection areas 18K, 18M, 18C, 18Y is elongated in the main scanning direction and has generally the same shape and size as the ejection face 10*a*. The ejection areas 18K, 18M, 18C, 18Y are arranged from the downstream side toward the upstream side in the conveying direction so as not to overlap one another. In other words, the ejection areas 18K, 18M, 18C, 18Y are arranged from the downstream side in the conveying direction in order of increasing lightness of color. It is noted that the increasing order of the lightness is black, magenta, cyan; and yellow (black (K)<magenta (M)<cyan (C)<yellow (Y)). Further, each of the ejection areas 18K, 18M, 18C, 18Y is divided into first to nth partial areas in the conveying direction ("n" is an integer equal to or greater than two). It is noted that FIG. 5 illustrates only partial areas of the ejection area 18K, but each of the other ejection areas 18M, 18C, 18Y has the same configuration as the ejection area 18K. It is further noted that FIG. 5 shows the partial areas are indicated by one-dot chain lines, but they are conceptual illustrations, that is, the partial areas are invisible. The first to nth partial areas are ink ejection areas respectively corresponding to first to nth preliminary ejection periods each of which is a period in which the preliminary ejection region 8*y* faces the ejection face 10*a*. Each of the first to nth partial areas is an area elongated in the main scanning direction so as to have a width corresponding to a single line (i.e., one pixel) in the conveying direction. The first to nth partial areas are arranged in parallel from the downstream side toward the upstream side in the conveying direction so as not to overlap one another.

The non-ejection region 8*z* is an area onto which no ink is ejected, and disposed between (a) a downstream end portion of the support regions 8*x* in the conveying direction and (b) an upstream end portion of the preliminary ejection region 8*y* in the conveying direction. The non-ejection region 8*z* includes a flow stopping portion 8*z*1 for stopping the ink having been ejected onto the preliminary ejection region 8*y* from flowing toward the upstream side of the flow stopping portion 8*z*1 in the conveying direction. The flow stopping portion 8*z*1 has a width equal to the width of the support face 8*a* in the main scanning direction and a length about half the length of the non-ejection region 8*z* in the conveying direction.

The preliminary ejection region 8*y* and the non-ejection region 8*z* have been subjected to ink repellent treatment on the support face 8*a* except the flow stopping portion 8*z*1. One example of the ink repellent treatment includes forming an ink repellent layer or film by, e.g., evaporating or dipping a material having an ink repellent property and containing fluorine atoms. The flow stopping portion 8*z*1 is an area not subjected to the ink repellent treatment on the support face 8*a*. Surface roughness of the flow stopping portion 8*z*1 is larger than that of the preliminary ejection region 8*y* and other regions which have been subjected to the ink repellent treatment.

It is noted that a thickness of the sheet-convey belt 8 is constant over its entire length in its circumferential direction, and there is little difference in thickness among the regions 8; 8*y*, 8*z* (except a thin layer formed by the ink repellent treatment).

Figure 6:
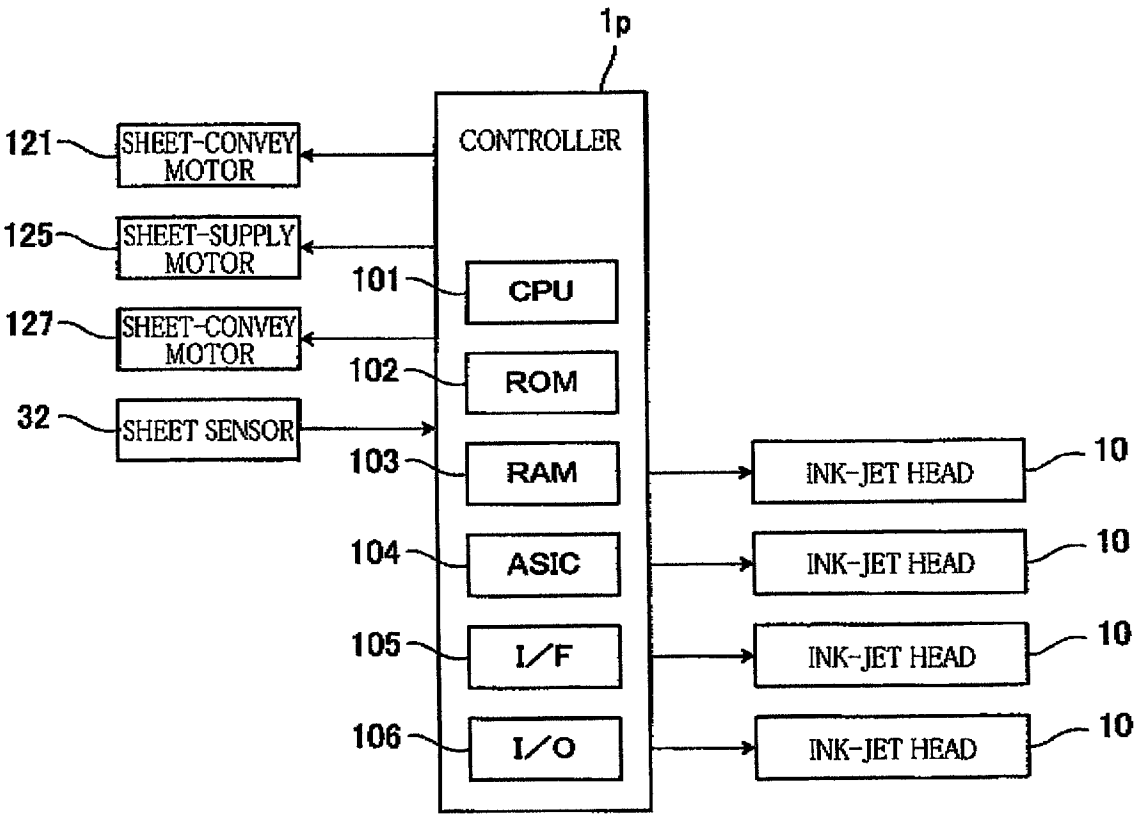
FIG. 6 is a block diagram showing an electric construction of the printer.

There will be next explained an electric construction of the printer 1 with reference to FIG. 6.

As shown in FIG. 6, the controller 1*p* includes a Central Processing Unit (CPU) 101, a Read Only Memory (ROM) 102, a Random Access Memory (RAM) 103 such as a non-volatile RAM, an Application Specific Integrated Circuit (ASIC) 104, an interface (I/F) 105, an Input/Output Port (I/O) 106, and so on. The ROM 102 stores therein programs executed by the CPU 101, various fixed data, and so on. The RAM 103 temporarily stores therein data required for the execution of the programs. One example of the data required for the execution of the programs includes: image data relating to an image to be formed on the sheet P; an ejection history of each of the ejection openings 14*a*; and the like. The ASIC 104 performs, e.g., rewriting and sorting of the image data. Specifically, the ASIC 104 performs a signal processing and an image processing, for example. The I/F 105 transmits or receives data to or from the external device. The I/O 106 inputs or outputs detection signals of various sensors.

The controller 1*p* is connected to the motors 121, 125, 127, the sheet sensor 32, the control boards for the respective heads 10, and so on.

There will be next explained a recording processing of the recording operation (including the preliminary ejection) controlled by the controller 1*p*. Processings explained below are executed by the CPU 101 in accordance with the programs stored in the ROM 102.

The preliminary ejection is ejection not contributing (i.e., not relating directly) to the image recording. That is, the preliminary ejection is ejection in which each head 10 ejects ink droplets not to constitute the image to be recorded. In the present embodiment, the preliminary ejection is performed each time before the image recording on the sheet P is started. That is, where the image recording is performed on two or more sheets P, that is, where continuous recording is performed, the preliminary ejection is performed within a period between each consecutive two recordings on the sheets P.

Where the controller 1*p* has received the recording command from the external device, the controller 1*p* controls the ink ejection for the image recording on the basis of the image data included in the recording command, and controls the ink ejection for the preliminary ejection on the basis of preliminary ejection data.

The controller 1*p* produces the preliminary ejection data for each preliminary ejection period and for each head 10. In producing the preliminary ejection data, the controller 1*p* selects the ejection opening(s) 14*a* from which the ink is ejected within the preliminary ejection period, on the basis of an ejection history of each of the ejection openings 14*a* of the head 10 within periods immediately before and after the preliminary ejection period. For example, the controller 1*p* selects, from among the ejection openings 14*a*, ejection openings 14*a* from which the ejecting operation has not been performed for equal to or longer than a certain length of time (e.g., the ejecting operation has not been performed in the image recording just before the preliminary ejection period). The controller 1*p* then produces the preliminary ejection data such that the ink is ejected from the selected ejection opening (s) 14*a* onto the preliminary ejection region 8*y* in the preliminary ejection. The controller 1*p* controls the head 10 and the sheet-convey belt 8 on the basis of the preliminary ejection data such that the ink is ejected from the selected ejection opening(s) 14*a* onto the preliminary ejection region 8*y*.

Figure 7:
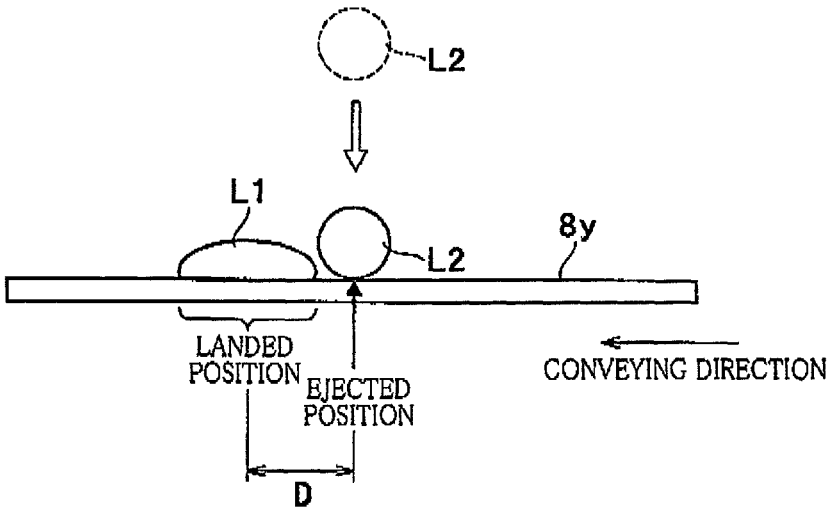
FIG. 7 is a schematic view showing an ink ejection manner in preliminary ejection.

In this operation, until a specific length of time has passed from the ejection of the ink from one of the ejection openings 14*a* onto the preliminary ejection region 8*y*, the controller 1*p* controls each head 10 and the sheet-convey belt 8 on the basis of the preliminary ejection data such that the ink for the preliminary ejection other than the ink ejected in this preliminary ejection is to be ejected onto positions on the preliminary ejection region 8*y* onto which the ink in this preliminary ejection is not ejected or landed. In the present embodiment, the specific length of time is a time required for n preliminary ejection periods appearing with intervals for one preliminary ejection region 8*y* and for one head 10. That is, the specific length of time is a time in which the sheet-convey belt 8 rotates n times. Specifically, as shown in FIG. 7, when ink L1 ejected from one of the ejection openings 14*a* is landed and located on the preliminary ejection region 8*y*, ink L2 ejected after the ink L1 is ejected onto an ejected position on the preliminary ejection region 8*y*, which position is different from a landed position (an occupied portion) of the ink L1. The ink L2 is an ink ejected for the preliminary ejection within a period until the specific length of time has passed from the ejection of the ink L1. In the present embodiment, a distance D in the conveying direction between the landed position of the ink L1 and the ejected position of the ink L2 ejected after the ink L1 within the period is equal to or longer than a width of a single line (one line). It is noted that, in FIG. 7, a direction from a right side toward a left side is the conveying direction.

Here, there will be explained the control of the preliminary ejection during the recording operation more specifically. The controller 1*p* stores an ejection start point (time) of the ink for the preliminary ejection, for each preliminary ejection region 8*y* and for each ejection opening 14*a*. The controller 1*p* then controls the head 10 and the sheet-convey belt 8 such that, within the specific length of time from the start of the ejection of the ink in the preliminary ejection onto one preliminary ejection region 8*y*, the ink is ejected onto the first to nth partial areas (see (1)-(n) of the ejection area 18K in FIG. 5) of the one preliminary ejection region 8*y* respectively within the first to nth preliminary ejection periods for each head 10. In this control, the controller 1*p* sets the ejected positions of the ink ejected from each ejection opening 14*a* such that the ejected positions are arranged along a line passing through a center of a width of each partial area in the conveying direction, for example. Further, the controller 1*p* sets a size of the ink ejected in the preliminary ejection from each ejection opening 14*a* such that the ink is located or fitted within the width of each partial area when the ink is landed on the preliminary ejection region 8*y*, for example.

The controller 1*p* performs a cleaning of the sheet-convey belt 8 for removing the ink landed on the preliminary ejection region 8*y*. The cleaning is performed each time when the recording operation (including the preliminary ejection) based on one recording command is finished. For example, the cleaning is performed, e.g., by rotating the sheet-convey belt 8 once in a state in which a cleaning member, not shown, such as a blade, a sponge, or the like is held in contact with the support face 8*a* of the sheet-convey belt 8.

Where the preliminary ejection periods for one preliminary ejection region 8*y* and for one head 10 have appeared the number of times exceeding n times before the recording operation (including the preliminary ejection) based on one recording command is finished (that is, the cleaning is performed), the controller 1*p* executes the following control. That is, the controller 1*p* controls each head 10 and the sheet-convey belt 8 such that, within a ($n*\alpha+m$)th preliminary ejection period for the one preliminary ejection region 8*y*

("α" is an integer equal to or greater than one, and "m" is an integer equal to or greater than one and equal to or less than "n"), the ink is ejected onto one of the first to nth partial areas (see (1)-(n) of the ejection area 18K in FIG. 5) which corresponds to an mth preliminary ejection period.

As described above, according to the printer 1, the controller 1*p*, and a storage medium storing the program in the present embodiment, since the above-described control of the controller 1*p* prevents a collision between the inks or ink droplets on the preliminary ejection region 8*y* as shown in FIG. 7, it is possible to prevent the ink ejected onto the preliminary ejection region 8*y* from flying and to prevent upsizing of the ink droplets on the support face 8*a* of the sheet-convey belt 8.

Where the preliminary ejection region 8*y* has the ink repellent property, a cleaning property of the preliminary ejection region 8*y* is improved (that is, it becomes easier to remove the ink and the like landed on the preliminary ejection region 8*y*), but the ink ejected onto the preliminary ejection region 8*y* is more likely to fly from the support face 8*a* of the sheet-convey belt 8. However, in the present embodiment, since the collision between the inks on the preliminary ejection region 8*y* is prevented as described above, it is possible to improve the cleaning property of the preliminary ejection region 8*y* while preventing the ink ejected onto the preliminary ejection region 8*y* from flying.

Further, where the preliminary ejection region 8*y* has the ink repellent property, the ink ejected onto the preliminary ejection region 8*y* is more likely to move to an outside of the preliminary ejection region 8*y* sliding on the support face 8*a*. In order to solve this problem, in the present embodiment, the non-ejection region 8*z* is provided between (a) the downstream end portion of the support regions 8*x* in the conveying direction and (b) the upstream end portion of the preliminary ejection region 8*y* in the conveying direction. As a result, even where the ink ejected onto the preliminary ejection region 8*y* has been moved toward the upstream side in the conveying direction, the non-ejection region 8*a* prevents the ink from being attached or moved to the support region 8*x* or the sheet P located on the support region 8*x*.

In addition, the flow stopping portion 8*z*1 provided on the non-ejection region 8*z* can reliably prevent the ink ejected onto the preliminary ejection region 8*y* from being attached or adhering to the support region 8*x* or the sheet P located on the support region 8*x*.

The preliminary ejection region 8*y* and the non-ejection region 8*z* have been subjected to ink repellent treatment on the support face 8*a* except the flow stopping portion 8*z*1. The flow stopping portion 8*z*1 is the portion of the support face 8*a*, which portion has not been subjected to the ink repellent treatment. This construction facilitates manufacturing the sheet-convey belt 8.

In the sheet-convey belt 8, the support regions 8*x* are the same in thickness as the preliminary ejection region 8*y*. Here, where the thickness of the sheet-convey belt 8 in the preliminary ejection region 8*y* is smaller than the thickness of the sheet-convey belt 8 in the support regions 8*x*, a strength of the sheet-convey belt 8 is lowered. Further, the thickness of the sheet-convey belt 8 in the preliminary ejection region 8*y* is larger than the thickness of the sheet-convey belt 8 in the support regions 8*x*, the sheet-convey belt 8 may be brought into contact with the ejection face 10*a*. However, in the present embodiment, since the thickness of the sheet-convey belt 8 in the preliminary ejection region 8*y* is the same as the thickness of the sheet-convey belt 8 in the support regions 8*x*, these problems can be reduced.

Where the head 10 is of the line type as in the present embodiment, problems caused by the ejection of the ink toward a cap in the preliminary ejection tend to be serious (examples of the problems include interference with a high-speed recording, upsizing of the printer 1, and the like). Accordingly, effects obtained by performing the preliminary ejection toward the sheet-convey belt 8 are relatively large. Further, where the head 10 is of the line type, the ejection areas or the first to nth partial areas (see (1)-(n) of the ejection area 18K in FIG. 5) of the preliminary ejection region 8*y* within the respective first to nth preliminary ejection periods are arranged in parallel from the downstream side toward the upstream side in the conveying direction. Accordingly, it is possible to shorten the length of the preliminary ejection region 8*y* in the conveying direction. As a result, a distance between the support regions 8*x* is shortened, thereby improving a conveyance efficiency and enabling the high-speed recording.

Also in the case where the printer 1 includes four line heads 10 as in the present embodiment, the ejection areas 18K, 18M, 18C, 18Y onto which the inks are respectively ejected from the heads 10 within n times of the preliminary ejection periods are arranged in parallel from the downstream side toward the upstream side in the conveying direction, and the ejection areas or the first to nth partial areas (see (1)-(n) of the ejection area 18K in FIG. 5) within the respective first to nth preliminary ejection periods are arranged in parallel from the downstream side toward the upstream side in the conveying direction. Accordingly, it is possible to shorten the length of the preliminary ejection region 8*y* in the conveying direction. As a result, the distance between the support regions 8*x* is shortened, thereby improving the conveyance efficiency and enabling the high-speed recording.

Where the ink having relatively low lightness of color has been landed on or attached to the sheet P, the deterioration of the recording quality becomes serious. However, in the present embodiment, as shown in FIG. 5, the ejection areas 18K, 18M, 18C, 18Y are arranged from the downstream side in the conveying direction in order of increasing lightness of color. Accordingly, the ink having the relatively low lightness of color is less likely to be attached to the sheet P, thereby effectively preventing the deterioration of the recording quality.

Each of the ejection areas or the first to nth partial areas (see (1)-(n) of the ejection area 18K in FIG. 5) within the respective first to nth preliminary ejection periods has the width of the single line. Accordingly, it is possible to reliably shorten the length of the preliminary ejection region 8*y* in the conveying direction. As a result, the distance between the support regions 8*x* is shortened, thereby improving the conveyance efficiency and enabling the high-speed recording.

The ink landed on the preliminary ejection region 8*y* dries over time, making it difficult to remove the ink by the cleaning. To solve this problem, where the preliminary ejection periods for one preliminary ejection region 8*y* and for one head 10 have appeared the number of times exceeding n times, the controller 1*p* executes the control such that the ink is ejected again from each head 10 onto the first to nth partial areas in order. That is, the controller 1*p* controls the head 10 and the sheet-convey belt 8 such that, after the specific length of time has passed from the ejection of the ink from the ejection opening 14*a* onto the preliminary ejection region 8*y* in the preliminary ejection, the ink for the preliminary ejection other than said ejected ink for the preliminary ejection is ejected onto the position on the preliminary ejection region 8*y* on which said ejected ink has been landed. In this control, a new ink is ejected onto a position of a landed ink ejected prior to the new ink and dried to some extent, thereby moisturizing the old ink. Accordingly, it is possible to improve the cleaning property. Further, since the old ink dried to some extent functions as an anchor for preventing the ink newly ejected from moving, it is possible to reliably prevent the ink from being attached to the support region 8*x* or the sheet P located on the support region 8*x*. It is noted that, in this case, since the old ink has an increased viscosity due to the drying, even where the new ink and the old ink collide with each other, the flying of the ink is less likely to occur.

In producing the preliminary ejection data, the controller 1*p* selects the ejection openings) 14*a* from which the ink is ejected within the preliminary ejection period, on the basis of the ejection history of each of the ejection openings 14*a* of the head 10 within periods immediately before and after the preliminary ejection period. In this case, it is possible to reliably prevent the collision between the inks on the preliminary ejection region 8*y* when compared with a case where the ink is ejected from all the ejection openings 14*a* in the preliminary ejection without using the ejection histories.

Figure 8:
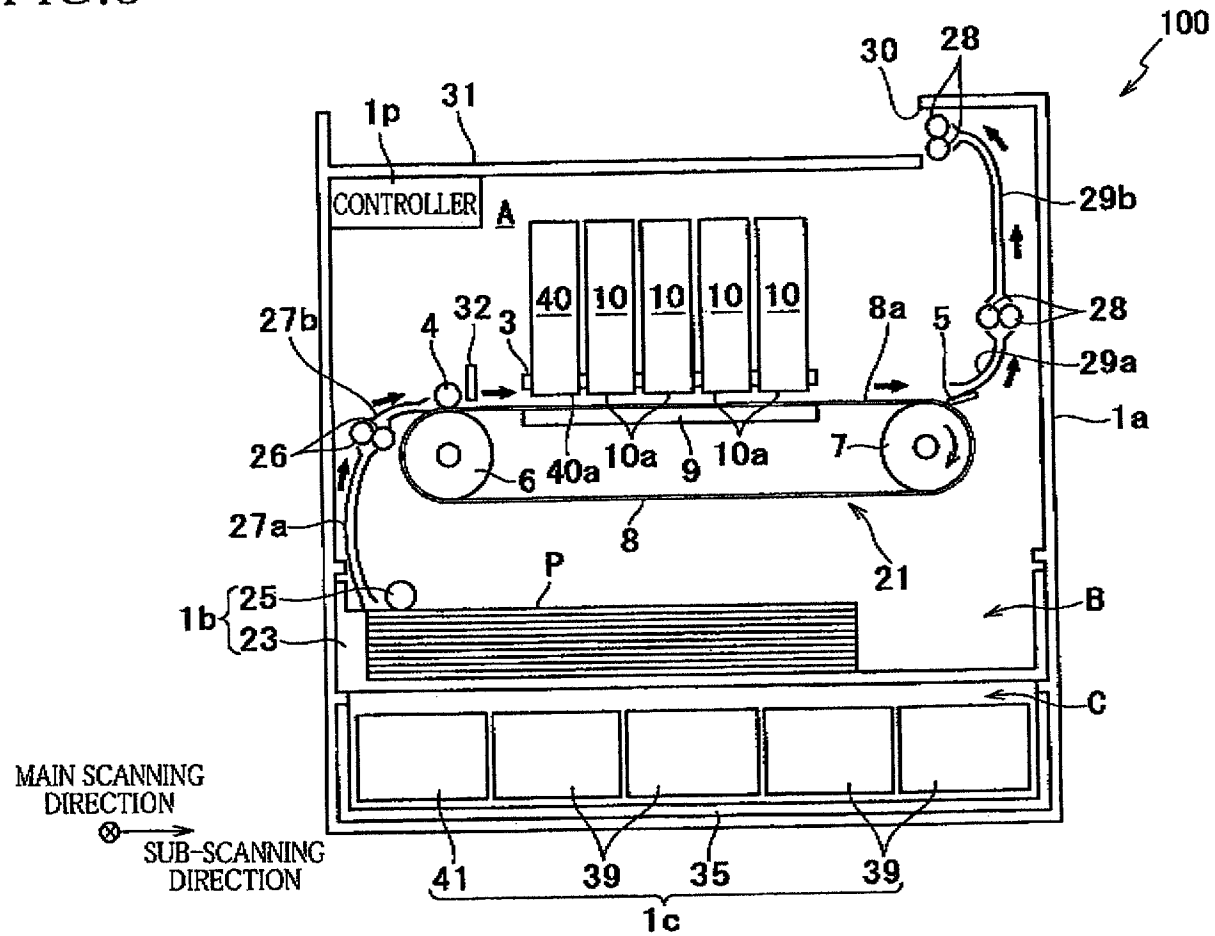
FIG. 8 is a side view generally showing an internal construction of an ink-jet printer as a second embodiment of the liquid ejection apparatus to which the present invention is applied.
Figure 9:
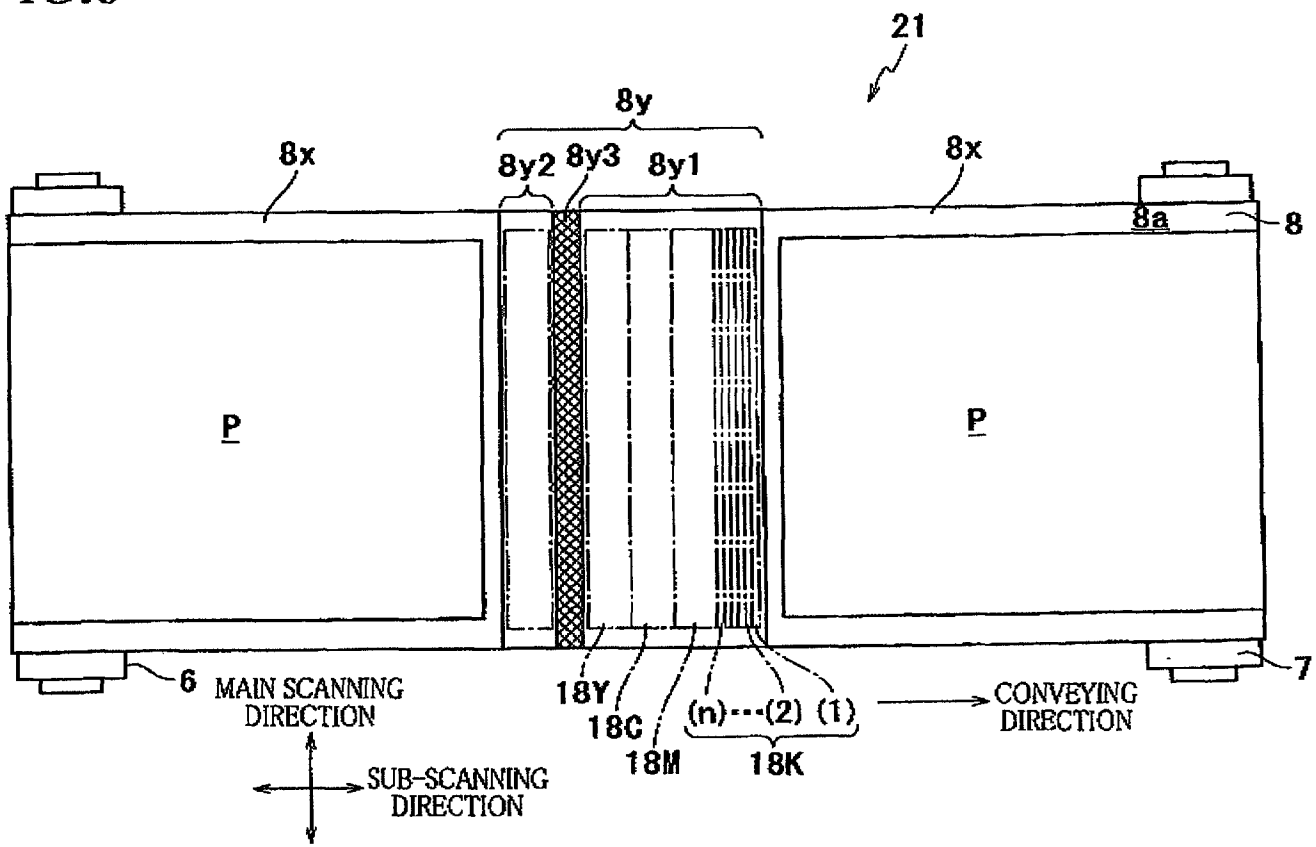
FIG. 9 is a plan view showing a sheet-convey belt of the printer shown in FIG. 8.
Figure 10:
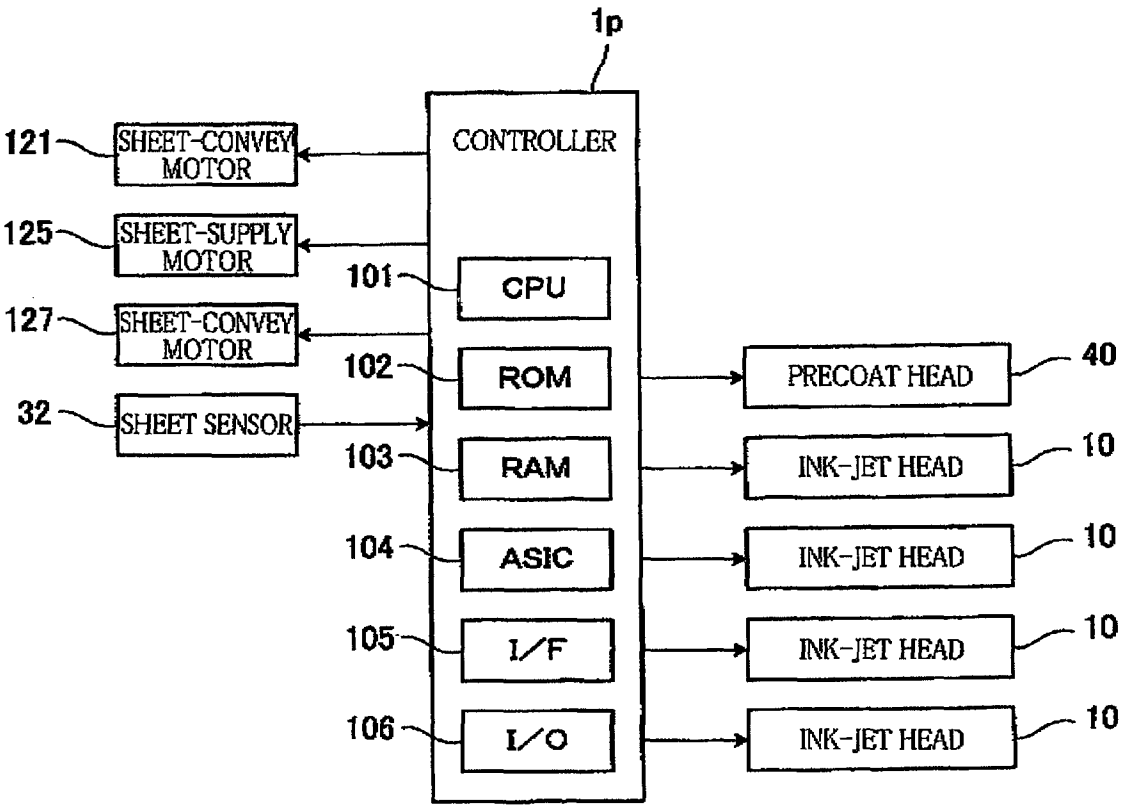
FIG. 10 is a block diagram showing an electric construction of the printer as the second embodiment.

There will be next explained an ink-jet printer 100 as a second embodiment of the present invention with reference to FIGS. 8, 9, and 10. In the explanation of this second embodiment, the same reference numerals used in the first embodiment may be used to identify the corresponding components, and an explanation of which is dispensed with.

As shown in FIGS. 8 and 10, the printer 100 as the second embodiment includes a precoat head 40 (as one example of a second head) configured to eject pretreatment liquid. The precoat head 40 is disposed in the space A at a position located on an upstream side of the heads 10 in the conveying direction. A cartridge 41 is disposed in the space C and stores the pretreatment liquid which is supplied to the precoat head 40 through a tube, not shown. The precoat head 40 has the same construction as each head 10. Further, as will be explained below, the precoat head 40, according to circumstances, ejects the pretreatment liquid from a second ejection face 40*a* as a lower face of the precoat head 40 onto the sheet P on which no ink has been landed or attached The pretreatment liquid is transparent liquid having properties for improving the recording quality. Examples of the properties include: a density improving property for improving a density of the ink ejected on the sheet P; a property for preventing spreading of the ink and strike-through of the ink which is a phenomenon in which the ink landed on a front face of the sheet P penetrate layers of the sheet P to spread or flow out to a back face the sheet P; a property for improving color saturation and quick dry of the ink; a property for preventing wrinkles and a curl made on the sheet P on which the ink has been landed; and the like. The pretreatment liquid is formed of a material such as liquid containing a cationic high polymer, liquid containing a polyvalent metal salt such as magnesium salt, and the like. Further, for pigment ink, pretreatment liquid for coagulating pigment color matter is used, and for dye ink, pretreatment liquid for precipitating dye color matter is used. When the ink is landed on a region of the sheet P to which such pretreatment liquid has been applied in advance, the polyvalent metal salt and so on react with dyes or pigments as coloring agent of the ink, thereby forming an insoluble or hardly soluble metal complex and so on by coagulating or precipitating.

As shown in FIG. 9, in the present second embodiment, the non-ejection region 8*z* is not provided on the support face 8*a* of the sheet-convey belt 8. The preliminary ejection region 8*y* includes an ink ejection area 8*y*1, a treatment-liquid ejection area 8*y*2, and a non-ejection area 8*y*3. The ink ejection area 8*y*1 is an area onto which the ink is ejected in the preliminary ejection. As in the first embodiment, the ink ejection area 8*y*1 includes ejection areas 18K, 18M, 18C, 18Y respectively corresponding to the four heads 10. The treatment-liquid ejection area 8*y*2 is located on an upstream side of the ink ejection area 8*y*1 in the conveying direction.

The treatment-liquid ejection area 8*y*2 is an area onto which the pretreatment liquid is ejected in the preliminary ejection. The treatment-liquid ejection area 8*y*2 has the same construction as that of each of the ejection areas 18K, 18M, 18C, 18Y of the ink ejection area 8*y*1. That is, the treatment-liquid ejection area 8*y*2 is elongated in the main scanning direction and has generally the same shape and size as an ejection face 40*a* as a lower face of the precoat head 40. The treatment-liquid ejection area 8*y*2 is divided into first to nth partial areas, not shown, in the conveying direction ("n" is an integer equal to or greater than two). Each of the first to nth partial areas of the treatment-liquid ejection area 8*y*2 is also an area elongated in the main scanning direction so as to have a width corresponding to a single line (i.e., one pixel) in the main scanning direction. Further, like the first to nth partial areas of each of the ejection areas 18K, 18M, 18C, 18Y, the first to nth partial areas of the treatment-liquid ejection area 8*y*2 are arranged in parallel from the downstream side toward the upstream side in the conveying direction so as not to overlap one another.

The non-ejection area 8*y*3 is an area onto which none of the ink and the pretreatment liquid is ejected and provided between the ink ejection area 8*y*1 and the treatment-liquid ejection area 8*y*2. The non-ejection area 8*y*3 has a width equal to the width of the support face 8*a* in the main scanning direction and a length about half the length of the treatment-liquid ejection area 8*y*2 in the conveying direction.

The preliminary ejection region 8*y* except the non-ejection area 8*y*3 (i.e., the ink ejection area 8*y*1 and the treatment-liquid ejection area 8*y*2) has been subjected to liquid repellent treatment on the support face 8*a* and accordingly has a liquid repellent property which is a property of rejecting the ink and the pretreatment liquid. One example of the liquid repellent treatment includes forming a liquid repellent layer or film by, e.g., evaporating or dipping a material having the liquid repellent property and containing fluorine atoms. The non-ejection area 8*y*3 is an area not subjected to the liquid repellent treatment on the support face 8*a*. Surface roughness of the non-ejection area 8*y*3 is larger than that of the ink ejection area 8*y*1 and other regions which have been subjected to the liquid repellent treatment. As a result, the non-ejection area 8*y*3 functions as a flow stopping portion for stopping the ink having been ejected onto the ink ejection area 8*y*1 from flowing toward the upstream side in the conveying direction.

There will be next explained the control of the controller 1*p* in the second embodiment of the present invention.

Where the controller 1*p* has received the recording command from the external device, the controller 1*p*, on the basis of the image data included in the recording command, controls each head 10 (and the precoat head 40 according to circumstances) to eject the corresponding ink (and the pretreatment liquid according to circumstances) for the image recording from the ejection openings 14*a*. In addition, on the basis of the preliminary ejection data, the controller 1*p* controls each head 10, 40 to eject the ink and the pretreatment liquid in the preliminary ejection from the ejection openings 14*a*.

The controller 1*p* produces the preliminary ejection data for each preliminary ejection period and for each head 10, 40. In producing the preliminary ejection data, the controller 1*p* selects the ejection opening(s) 14*a* from which the ink or the pretreatment liquid is ejected within the preliminary ejection period, on the basis of an ejection history of each of the ejection openings 14*a* of the heads 10 and 40 within periods immediately before and after the preliminary ejection period. For example, the controller 1*p* selects, from among the ejection openings 14*a*, ejection openings 14*a* from which the ejecting operation has not been performed for equal to or longer than a certain length of time (in the image recording performed just before the preliminary ejection period). The controller 1*p* then produces the preliminary ejection data such that the ink or the pretreatment liquid is ejected from the selected ejection opening(s) 14*a* onto the preliminary ejection region 8*y* in the preliminary ejection.

The controller 1*p* controls the heads 10, 40 and the sheet-convey belt 8 on the basis of the preliminary ejection data such that the ink is ejected from the selected ejection opening (s) 14*a* of each head 10 onto the ink ejection area 8*y*1 of the preliminary ejection region 8*y* and such that the pretreatment liquid is ejected from the selected ejection opening(s) 14*a* of the precoat head 40 onto the treatment-liquid ejection area 8*y*2 of the preliminary ejection region 8*y*.

In this operation, until a first specific length of time has passed from the ejection of the ink from one of the ejection openings 14*a* of each head 10 onto the ink ejection area 8*y*1, the controller 1*p* controls each head 10 and the sheet-convey belt 8 on the basis of the preliminary ejection data such that the ink for the preliminary ejection other than the ink ejected in this preliminary ejection is to be ejected onto positions on the ink ejection area 8*y*1 onto which the ink in this preliminary ejection is not ejected or landed. In the present embodiment, the first specific length of time is a time required for n preliminary ejection periods appearing with intervals for one preliminary ejection region 8*y* and for one head 10. That is, the first specific length of time is a time in which the sheet-convey belt 8 rotates n times. Specifically, as in the first embodiment, as shown in FIG. 7, when ink L1 ejected from one of the ejection openings 14*a* is landed and located on the preliminary ejection region 8*y* (the ink ejection area 8*y*1), ink L2 ejected after the ink L1 is ejected onto an ejected position on the preliminary ejection region 8*y* (the ink ejection area 8*y*1), which position is different from a landed position (an occupied portion) of the ink L1. The ink L2 is an ink ejected for the preliminary ejection within a period until the first specific length of time has passed from the ejection of the ink L1. Also in this second embodiment, a distance D in the conveying direction between the landed position of the ink L1 and the ejected position of the ink L2 ejected after the ink L1 within the period is equal to or longer than a width of a single line (one line).

Further, in this operation, until a second specific length of time has passed from the ejection of the pretreatment liquid from one of the ejection openings 14*a* of the precoat head 40 onto the treatment-liquid ejection area 8*y*2, the controller 1*p* controls the precoat head 40 and the sheet-convey belt 8 on the basis of the preliminary ejection data such that the pretreatment liquid for the preliminary ejection other than the pretreatment liquid ejected in this preliminary ejection is to be ejected onto positions on the treatment-liquid ejection area 8*y*2 onto which the pretreatment liquid in this preliminary ejection is not ejected or landed. In the present embodiment, the second specific length of time is a time required for n preliminary ejection periods appearing with intervals for the precoat head 40 and for one preliminary ejection region 8*y*. That is, like the first specific length of time, the second specific length of time is a time in which the sheet-convey belt 8 rotates n times. A specific control of this operation is the same as that explained with reference to FIG. 7.

Here, there will be explained the control of the preliminary ejection during the recording operation more specifically. The controller 1*p* stores an ejection start point (time) of the ink and the pretreatment liquid for the preliminary ejection, for each preliminary ejection region 8*y* and for each ejection opening 14*a*. The controller 1*p* then controls the heads 10, 40 and the sheet-convey belt 8 such that, within each of the first and second specific lengths of time from the start of the ejection of the ink and the pretreatment liquid in the preliminary ejection onto one preliminary ejection region 8*y*, the ink and the pretreatment liquid are ejected onto the first to nth partial areas (see (1)-(n) of the ejection area 18K in FIG. 9) of the one preliminary ejection region 8*y* respectively within the first to nth preliminary ejection periods for each head 10, 40. In this control, the controller 1*p* sets the ejected positions of the ink and the pretreatment liquid ejected from each ejection opening 14*a* such that the ejected positions are arranged along a line passing through a center of a width of each partial area, for example. Further, the controller 1*p* sets a size of each of the ink and the pretreatment liquid ejected in the preliminary ejection from each ejection opening 14*a* such that each of the ink and the pretreatment liquid is located or fitted within the width of each partial area when the ink and/or the pretreatment liquid is landed on the preliminary ejection region 8*y*, for example.

Where the preliminary ejection periods for one preliminary ejection region 8*y* and for one head 10 have appeared the number of times exceeding n times before the recording operation (including the preliminary ejection) based on one recording command is finished (that is, the cleaning is performed), the controller 1*p* executes the following control. That is, the controller 1*p* controls each head 10, 40 and the sheet-convey belt 8 such that, within a ($n*\alpha+m$)th preliminary ejection period for the one preliminary ejection region 8*y* ("$\alpha$" is an integer equal to or greater than one, and "m" is an integer equal to or greater than one and equal to or less than "n"), each head 10, 40 ejects the ink or the pretreatment liquid onto one of the first to nth partial areas (see (1)-(n) of the ejection area 18K in FIG. 9) which corresponds to an mth preliminary ejection period.

It is noted that, in the above-described embodiment, the controller 1*p* executes the control such that the ink is ejected onto the position different from the position at which the ink has been already landed, until the first specific length of time has passed from the ejection of the ink onto the ejection area 8*y*1. Further, the controller 1*p* executes the control such that the pretreatment liquid is ejected onto the position different from the position at which the pretreatment liquid has been already landed, until the second specific length of time has passed from the ejection of the pretreatment liquid onto the ejection area 8*y*2, but the present invention is limited to this configuration. For example, the controller 1*p* may execute a control such that the ink is ejected onto the position at which the ink has been already landed even where the first specific length of time has not passed. Further, the controller 1*p* may execute a control such that the pretreatment liquid is ejected onto the position at which the pretreatment liquid has been already landed even where the second specific length of time has not passed.

As described above, according to the printer 1, the controller 1*p*, and the storage medium storing the program as the present embodiment, as shown in FIG. 9, the pretreatment liquid is landed on the preliminary ejection region 8*y* at a position located upstream side of the landed position of the ink in the conveying direction. Thus, even where the ink for the preliminary ejection has flown upon a collision with the support face 8*a* of the sheet-convey belt 8, the pretreatment liquid lowers a possibility that the ink is attached to the support region 8x or the sheet P located on the support region 8x. Further, even where the ink ejected onto the preliminary ejection region 8y has been moved to the upstream side in the conveying direction, the pretreatment liquid lowers a possibility that the ink is attached or moved to the support region 8x or the sheet P located on the support region 8x. Accordingly, it is possible to prevent the ink ejected onto the preliminary ejection region 8y provided on the support face 8a of the sheet-convey belt 8 from being attached to the support region 8x or the sheet P located on the support region 8x. It is noted that, even where the pretreatment liquid has been attached to the support region 8x or the sheet P located on the support region 8x, the pretreatment liquid does not adversely affect the recording quality because the pretreatment liquid is transparent.

Where the ink has been further ejected onto a position of undried ink having already been ejected and landed on the preliminary ejection region 8y, the collision between the inks may cause flying of the ink, an upsizing of the ink droplets on the support face 8a of the sheet-convey belt 8, and the like. The flown ink may be attached to the ejection faces 10a, 40a and/or the support region 8x or the sheet P located on the support region 8x. In addition, the upsized ink droplet may be attached to the ejection faces 10a, 40a or may be moved to the upstream side in the conveying direction by an inertial force generated by the rotation of the sheet-convey belt 8 and attached to the support region 8x or the sheet P located on the support region 8x. However, in this second embodiment, the above-described control of the controller 1p can prevent the collision between the inks on the preliminary ejection region 8y as shown in FIG. 7, thereby reducing these problems.

Like the above-described collision between the inks, a collision between the pretreatment liquids or the pretreatment-liquid droplets on the preliminary ejection region 8y may cause problems such as flying of the pretreatment liquid and an upsizing of the liquid droplet on the face of the sheet-convey belt 8. However, in this second embodiment, the above-described control of the controller 1p can prevent the collision between the pretreatment liquids on the preliminary ejection region 8y, thereby reducing these problems.

Where the preliminary ejection region 8y has the liquid repellent property, the cleaning property of the preliminary ejection region 8y is improved (that is, it becomes easier to remove the ink and the like landed on the preliminary ejection region 8y), but the ink ejected onto the preliminary ejection region 8y is more likely to fly or move to the upstream side in the conveying direction, causing the problem that the ink is attached to the support region 8x or the sheet P located on the support region 8x. However, in this second embodiment, the pretreatment liquid can improve the cleaning property of the preliminary ejection region 8y while reducing the problem.

Where the ink and the pretreatment liquid are mixed with each other on the preliminary ejection region 8y, the ink is coagulated or solidified by a chemical reaction, making it difficult to remove the ink by the cleaning. However, in this second embodiment, the non-ejection area 8y3 prevents the ink and the pretreatment liquid from being mixed with each other on the preliminary ejection region 8y, thereby preventing a deterioration of the cleaning property of the preliminary ejection region 8y.

The non-ejection area 8y3 functions as the flow stopping portion which stops the ink ejected on the ink ejection area 8y1 from flowing toward the upstream side in the conveying direction. As a result, it is possible to reliably prevent the ink and the pretreatment liquid ejected onto the preliminary ejection region 8y from being mixed with each other.

The preliminary ejection region 8y except the non-ejection area 8y3 (i.e., the ink ejection area 8y1 and the treatment-liquid ejection area 8y2) has been subjected to the liquid repellent treatment on the support face 8a, and the non-ejection area 8y3 is not subjected to the liquid repellent treatment on the support face 8a. This configuration facilitates manufacturing the sheet-convey belt 8.

Where the heads 10, 40 are of the line type as in the present embodiment, problems caused by the ejection of the ink or the pretreatment liquid toward the cap in the preliminary ejection tend to be serious (examples of the problems include the interference with the high-speed recording, the upsizing of the printer 1, and the like). Accordingly, the effects obtained by performing the preliminary ejection toward the sheet-convey belt 8 are relatively large. Further, where the heads 10, 40 are of the line type, the ejection areas or the first to nth partial areas (see (1)-(n) of the ejection area 18K in FIG. 9) of the preliminary ejection region 8y within the respective first to nth preliminary ejection periods are arranged in parallel from the downstream side toward the upstream side in the conveying direction. Accordingly, it is possible to shorten the length of the preliminary ejection region 8y in the conveying direction while preventing the collision between the inks and the collision between the pretreatment liquids. That is, while preventing the collision between the inks and the collision between the pretreatment liquids, it is possible to shorten the distance between the support regions 8x, thereby improving the conveyance efficiency and enabling the high-speed recording.

Even where the printer 1 includes four line heads 10 as in the present embodiment, the ejection areas 18K, 18M, 18C, 18Y onto which the inks are respectively ejected from the heads 10 within n times of the preliminary ejection periods are arranged in parallel from the downstream side toward the upstream side in the conveying direction, and the ejection areas or the first to nth partial areas (see (1)-(n) of the ejection area 18K in FIG. 9) within the respective first to nth preliminary ejection periods are arranged in parallel from the downstream side toward the upstream side in the conveying direction. Accordingly, it is possible to shorten the length of the preliminary ejection region 8y in the conveying direction. As a result, the distance between the support regions 8x is shortened, thereby improving the conveyance efficiency and enabling the high-speed recording.

Where the ink having relatively low lightness of color has been attached to the sheet P, the deterioration of the recording quality becomes serious. However, in the present embodiment, as shown in FIG. 9, the ejection areas 18K, 18M, 18C, 18Y are arranged from the downstream side in the conveying direction in order of increasing lightness of color. Accordingly, the ink having the relatively low lightness of color is less likely to be attached to the sheet P, thereby effectively preventing the deterioration of the recording quality.

The ink landed on the preliminary ejection region 8y dries over time, making it difficult to remove the ink by the cleaning. To solve this problem, where the preliminary ejection periods for one preliminary ejection region 8y and for one head 10 have appeared the number of times exceeding n times, the controller 1p executes the control such that the ink is ejected again from each head 10 onto the first to nth partial areas in order. That is, the controller 1p controls the head 10 and the sheet-convey belt 8 such that, after the first specific length of time has passed from the ejection of the ink from the ejection opening 14a onto the preliminary ejection region 8y in the preliminary ejection, the ink for the preliminary ejection other than said ejected ink for the preliminary ejection is ejected onto the position on the preliminary ejection region 8y on which said ejected ink has been landed. In this control, a new ink is ejected onto a position of a landed ink ejected before the new ink and dried to some extent, thereby moisturizing the old ink. Accordingly, it is possible to improve the cleaning property. Further, since the old ink dried to some extent functions as an anchor for preventing the ink newly ejected from moving, it is possible to reliably prevent the ink from being attached to the support region 8*x* or the sheet P located on the support region 8*x*. It is noted that, in this case, since the old ink has an increased viscosity due to the drying, even where the new ink and the old ink collide with each other, the flying of the ink is less likely to occur.

As in the case of the ink, the pretreatment liquid landed on the preliminary ejection region 8*y* dries over time, making it difficult to remove the pretreatment liquid by the cleaning. However, in this second embodiment, by the control of the controller 1*p* as in the above-described control for the ink, a new pretreatment liquid is ejected onto a landed position of an old pretreatment liquid ejected before the new pretreatment liquid and dried to some extent, thereby moisturizing the old pretreatment liquid. Accordingly, it is possible to improve the cleaning property. Further, also in this case, the anchor effect can be obtained as in the case of the ink. It is noted that, in this case, even where the old pretreatment liquid and the new pretreatment liquid collide with each other, the flying of the pretreatment liquid is less likely to occur.

Each of the ejection areas or the first to nth partial areas (see (1)-(n) of the ejection area 18K in FIG. 9) within the respective first to nth preliminary ejection periods has the width of the single line. Accordingly, it is possible to reliably shorten the length of the preliminary ejection region 8*y* in the conveying direction. As a result, the distance between the support regions 8*x* is shortened, thereby improving the conveyance efficiency and enabling the high-speed recording.

In producing the preliminary ejection data, the controller 1*p* selects the ejection opening(s) 14*a* from which the ink or the pretreatment liquid is ejected within the preliminary ejection period, on the basis of the ejection history of each of the ejection openings 14*a* of the heads 10, 40 within periods immediately before and after the preliminary ejection period. In this case, it is possible to reliably prevent the collision between the inks and the collision between the pretreatment liquids on the preliminary ejection region 8*y* when compared with a case where the ink or the pretreatment liquid is ejected from all the ejection openings 14*a* in the preliminary ejection without using the ejection histories.

Figure 11:
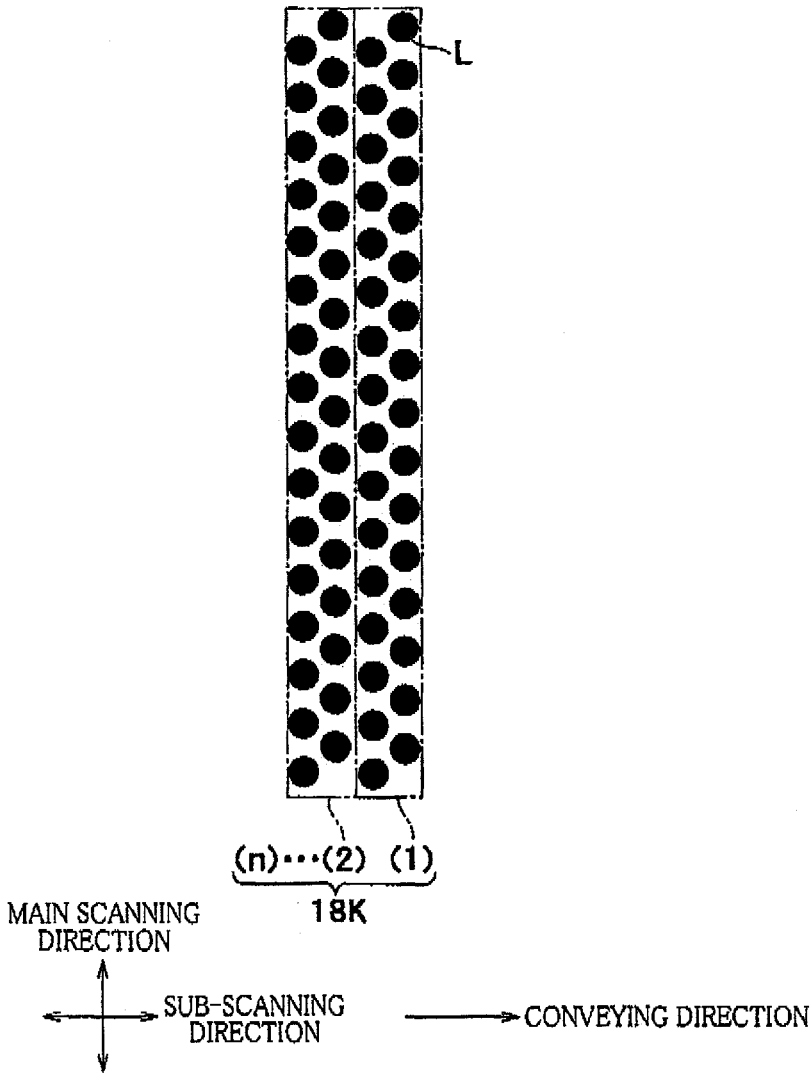
FIG. 11 is a schematic view showing an ejection manner of the ink or pretreatment liquid in preliminary ejection.

There will be next explained a third embodiment of the present invention with reference to FIG. 11.

In this third embodiment, each of the ejection areas or the first to nth partial areas (see (1)-(n) of the ejection area 18K in FIG. 11) within the respective first to nth preliminary ejection periods has a width of two lines. The controller 1*p* controls each head 10, 40 and the sheet-convey belt 8 such that, in each of the first to nth partial areas, positions which constitute one of two lines extending in the main scanning direction and onto which the ink or pretreatment liquid L is to be ejected and positions which constitute the other of two lines and onto which the ink or pretreatment liquid L is to be ejected are alternately arranged between two positions in the conveying direction.

In this third embodiment, it is possible to effectively prevent overlap of the inks or pretreatment liquids L on the preliminary ejection region 8*y*. As a result, it is possible to reliably prevent the flying of the ink and the pretreatment liquid ejected onto the preliminary ejection region 8*y* and the upsizing of the liquid droplets on the support face 8*a* of the sheet-convey belt 8.

While the embodiments of the present invention have been described above, it is to be understood that the invention is not limited to the details of the illustrated embodiments, but may be embodied with various changes and modifications, which may occur to those skilled in the art, without departing from the spirit and scope of the invention.

The ejected positions of the liquid in each of the preliminary ejection periods are not particularly limited as long as the ejected positions are in the preliminary ejection region and does not overlap the landed positions (the occupied portions) on which the liquid has been already landed. That is, the occupied portions of the liquid on the preliminary ejection region may partly overlap each other after the liquid is landed on the preliminary ejection region. Also in this case, since the collision between the liquids or the liquid droplets on the preliminary ejection region is prevented, it is possible to prevent the flying of the liquid ejected onto the preliminary ejection region and the upsizing of the liquid droplets on the face of the sheet-convey belt. In particular, it is possible to effectively prevent the upsizing of the liquid droplet by setting the ejected positions of the liquid in each preliminary ejection period such that the ejected positions are distant from the positions on which the liquid has already been landed, by such a distance that the liquid ejected onto the preliminary ejection region does not overlap the landed positions of the liquid which has been landed on the preliminary ejection region.

The width of each of the ejection areas within the respective preliminary ejection periods is not particularly limited and may be a width of more than two lines, for example.

Further, where the preliminary ejection periods for one preliminary ejection region 8*y* and for one head 10 have appeared the number of times exceeding n times, the controller 1*p* does not need to control the head 10 to eject the ink onto the first to nth partial areas in order again. For example, the cleaning may be performed after the nth preliminary ejection period. This modification is applicable to the precoat head 40 (the pretreatment liquid).

Further, in producing the preliminary ejection data, the controller 1*p* may select, from among the ejection openings 14*a*, ejection openings 14*a* from which the ejecting operation has not been performed for equal to or longer than the certain length of time within the preliminary ejection period and the preliminary ejection periods just before and/or after the preliminary ejection period. Further, the controller 1*p* is not limited to select the ejection opening(s) 14*a* from which the liquid is ejected within the preliminary ejection period, on the basis of the ejection history of each of the ejection openings 14*a* within periods immediately before and after the preliminary ejection period. For example, the liquid may be ejected from all the ejection openings 14*a* in the preliminary ejection regardless of the ejection histories.

The preliminary ejection may be performed each time when the image recording has been performed on two or more recording media. Further, the preliminary ejection does not need to be performed at fixed intervals and may be performed at any timings.

Where liquids respectively having different lightnesses are ejected by a plurality of heads, the ejection areas within each preliminary ejection period may be arranged independently of the lightnesses.

The colors of the inks ejected from the plurality of the heads are not limited to the above-described four colors, namely, black (K), magenta (M), cyan (C), and yellow (Y), and may be three colors (e.g., magenta (M), cyan (C), yellow (Y)) or other colors.

Instead of the piezoelectric actuator, each head may have an ejection energy generating portions of another type such as an electrostatic element for applying voltage and a thermal heater element. Further, each head may eject liquid other than the ink and the pretreatment liquid. A liquid ejecting portion of the head includes: physical configurations of the actuator units 17 and a power-source system required for operating the actuator units 17; and a controller for controlling the actuators, the power-source system, and so on.

A drive portion of the sheet-convey belt includes: physical configurations of the sheet-convey motor 121 and a power-source system required for operating the sheet-convey motor 121; and a controller for controlling the sheet-convey motor 121, the power-source system, and so on.

The liquid ejection apparatus is not limited to include a plurality of heads for ejecting the recording liquid and may include a single head.

The thickness of the sheet-convey belt may be different at the support region and at the preliminary ejection region.

The preliminary ejection region preferably has a non-absorbency from the viewpoint of improving the cleaning property for the preliminary ejection region. The non-absorbency is a property including the liquid repellent property, a lyophobic property, a lyotropic property, and the like. However, the preliminary ejection region does not need to have the non-absorbency.

The flow stopping portion is not limited to the portion of the face of the sheet-convey belt, which portion is not subjected to the liquid repellent treatment. For example, the flow stopping portion may be formed by an absorbing member, a projecting portion projecting from the preliminary ejection region toward the ejection face, or the like. The position of the flow stopping portion is not limited to the position located on a downstream side of the non-ejection region in the conveying direction and may be located at any position on the non-ejection region.

The non-ejection region is not limited to include the flow stopping portion as long as the liquid is not ejected onto the non-ejection region. For example, the non-ejection region may be located on an extension of the preliminary ejection region. Further, the non-ejection region may not be provided on the face of the sheet-convey belt.

The recording medium is not limited to the sheet and may be various types of media.

The application of the present invention is not limited to the printer. For example, the present invention is applicable to a facsimile machine, a copying machine, and the like.

Further, the ejected positions of the recording liquid and the treatment liquid within each preliminary ejection period may be changed as long as the treatment liquid is landed at positions located on an upstream side of the landed positions of the recording liquid in the conveying direction on the preliminary ejection region.

For example, the recording liquid or the treatment liquid may be further ejected onto the positions at which the recording liquid or the treatment liquid having already been ejected is landed in an undried state. It is noted that, as long as the ejected position of the recording liquid or the treatment liquid does not overlap the landed position on which the recording liquid or the treatment liquid has already been landed, it is possible to prevent the collision between the recording liquids and the collision between the treatment liquids on the preliminary ejection region, thereby preventing the flying of the recording liquid or the treatment liquid and the upsizing of the liquid droplet. Accordingly, even where the occupied portions of the recording liquid or the occupied portions of the treatment liquid are partly overlap with each other in each ejection area after the recording liquid or the treatment liquid is landed on the preliminary ejection region, the above-described advantages can be obtained.

The non-ejection area is not limited to include the flow stopping portion as long as the recording liquid or the treatment liquid is ejected onto the non-ejection area. For example, the non-ejection area may have a liquid repellent property like the other areas of the preliminary ejection region (i.e., the ink ejection area and the treatment-liquid ejection area). Further, the non-ejection area may not be provided on the preliminary ejection region.

The treatment liquid may have any property and be formed of any material as long as the treatment liquid is transparent liquid. The treatment liquid is not limited to the pretreatment liquid (i.e., the liquid applied to a recording medium on which the recording liquid is not landed) and may be aftertreatment liquid (i.e., liquid applied to a recording medium on which the recording liquid has been landed).

The recording liquid is not limited to the ink and may be liquid other than the ink.

Further, in the above-described embodiments, the ejection areas within the respective first to nth preliminary ejection periods for each head 10 are arranged in parallel from the downstream side toward the upstream side in the conveying direction, but the present invention is not limited to this configuration. For example, this printer 1 may be configured such that the ejection areas within the respective first to nth preliminary ejection periods for each head 10 are arranged in parallel so as not to be arranged in order from the downstream side toward the upstream side in the conveying direction. That is, the ejection areas may be randomly arranged in parallel in the conveying direction.

What is claimed is:

1. A liquid ejection apparatus comprising.

at least one head each having an ejection face which has a plurality of ejection openings opened therein for ejecting liquid onto a recording medium, the at least one head comprising at least one first head having a first ejection face as the ejection face and the first ejection face having a plurality of first ejection openings formed therein as the plurality of ejection openings for ejecting recording liquid onto the recording medium;

a convey belt which has a support region and at least one preliminary ejection region each provided on a face of the convey belt and which is configured to convey the recording medium in a conveying direction parallel to the ejection face by moving the face of the convey belt in a state in which the face faces the ejection face, wherein the support region is a region for supporting the recording medium, wherein the preliminary ejection region is a region onto which the liquid is ejected from the ejection openings in preliminary ejection, and wherein the preliminary ejection is ejection not contributing to image recording; and a controller configured to control the head and the convey belt;

wherein the controller is configured to control the head and the convey belt on the basis of preliminary ejection data for the preliminary ejection such that, until a specific length of time has passed from a certain ejection of the recording liquid from one of the ejection openings onto the preliminary ejection region, a plurality of recording liquids ejected from one of the ejection openings in the preliminary ejection are landed on positions in the preliminary ejection region that do not overlap with each other, and such that, after the specific length of time has passed from the certain ejection of the recording liquid, each of at least one recording liquid ejected from the one of the ejection openings in a current ejection is landed onto a corresponding one of the plurality of recording liquids that landed the specific length of time before the current ejection of the at least one recording liquid, and wherein the controller is configured to control the head and the convey belt such that the plurality of recording liquids receives the recording liquid ejected from the one of the ejection openings the specific length of time after the certain ejection in order of length of time the plurality of recording liquids have been landed, starting with the greatest length of time.

2. The liquid ejection apparatus according to claim 1, wherein the at least one head comprises a second head having a second ejection face as the ejection face, the second ejection face having a plurality of second ejection openings formed therein as the plurality of ejection openings for ejecting transparent treatment liquid onto the recording medium, wherein the support region of the convey belt is disposed on an upstream side of the preliminary ejection region in the conveying direction, the convey belt being configured to convey the recording medium in the conveying direction parallel to the first ejection face and the second ejection face by moving the face of the convey belt in a state in which the face faces the first ejection face and the second ejection face, and wherein the controller is configured to control the first head, the second head, and the convey belt on the basis of the preliminary ejection data such that the recording liquid is ejected from the plurality of first ejection openings and landed on the preliminary ejection region, and thereafter the treatment liquid is ejected to be landed on a position in the preliminary ejection region, which position is located on an upstream side of a position on which the recording liquid has been landed, in the conveying direction.

3. The liquid ejection apparatus according to claim 2, wherein the controller is configured to control the second head and the convey belt on the basis of the preliminary ejection data such that, until a second specific length of time has passed from the ejection of the treatment liquid from the plurality of second ejection openings onto the preliminary ejection region, treatment liquid for the preliminary ejection is landed on a position in the preliminary ejection region in current ejection, which position does not overlap any of at least one position of the treatment liquid landed after the ejection of the treatment liquid from which the specific length of time has passed.

4. The liquid ejection apparatus according to claim 1, wherein the preliminary ejection region has a liquid repellent property to the liquid.

5. The liquid ejection apparatus according to claim 1, wherein the support region is disposed on an upstream side of the preliminary ejection region in the conveying direction, and wherein the face of the convey belt has a non-ejection region onto which no liquid is ejected, wherein the non-ejection region is provided between a downstream end portion of the support region in the conveying direction and an upstream end portion of the preliminary ejection region in the conveying direction.

6. The liquid ejection apparatus according to claim 2, wherein the face of the convey belt has a non-ejection region onto which none of the recording liquid and the treatment liquid is ejected, wherein the non-ejection region is provided between an ejection area onto which the recording liquid is ejected and an ejection area onto which the treatment liquid is ejected.

7. The liquid ejection apparatus according to claim 5, wherein the non-ejection region includes a flow stopping portion configured to stop the recording liquid landed on the preliminary ejection region from flowing toward an upstream side in the conveying direction, the flow stopping portion having at least one of (a) surface roughness larger than that of the preliminary ejection region and (b) a projection projecting in a direction from the preliminary ejection region toward the ejection face.

8. The liquid ejection apparatus according to claim 7, wherein the preliminary ejection region and the non-ejection region except the flow stopping portion are formed by applying liquid repellent treatment to the face of the convey belt, and wherein the flow stopping portion is a portion not subjected to the liquid repellent treatment on the face of the convey belt.

9. The liquid ejection apparatus according to claim 1, wherein a thickness of the support region is the same as that of the preliminary ejection region.

10. The liquid ejection apparatus according to claim 1, wherein each of the at least one head is formed by a line head having the ejection face elongated in a main scanning direction perpendicular to the conveying direction, the ejection openings being arranged in the main scanning direction, wherein one of the at least one preliminary ejection region faces the ejection face within a preliminary ejection period, the one preliminary ejection region having a plurality of ejection areas each elongated in the main scanning direction, wherein the preliminary ejection period is a period in which the one preliminary ejection region faces the ejection face, and wherein, where the preliminary ejection period appears n times at intervals within the specific length of time from a start of the ejection of the liquid onto the one preliminary ejection region in the preliminary ejection, the controller controls the head and the convey belt such that the liquid is ejected within each of the preliminary ejection periods onto a corresponding one of the ejection areas and such that the ejection areas for the respective first to nth preliminary ejection periods are arranged in parallel in the conveying direction, wherein n is an integer equal to or greater than two.

11. The liquid ejection apparatus according to claim 10, wherein the at least one head is a plurality of heads arranged in the conveying direction, and wherein the controller is configured to control the plurality of heads and the convey belt such that the ejection areas for the respective first to nth preliminary ejection periods for each of the plurality of heads are arranged in parallel in the conveying direction in the one preliminary ejection region and such that the ejection areas for the respective first to nth preliminary ejection periods and for each of the plurality of heads are arranged in parallel in the conveying direction.

12. A liquid ejection apparatus, comprising:

at least one head each having an ejection face which has a plurality of ejection openings opened therein for ejecting liquid onto a recording medium;

a convey belt which has a support region and at least one preliminary ejection region each provided on a face of the convey belt and which is configured to convey the recording medium in a conveying direction parallel to the ejection face by moving the face of the convey belt in a state in which the face faces the ejection face, wherein the support region is a region for supporting the recording medium, wherein the preliminary ejection region is a region onto which the liquid is ejected from the ejection openings in preliminary ejection, and wherein the preliminary ejection is an ejection not contributing to image recording; and a controller configured to control the head and the convey belt;

wherein the controller is configured to control the head and the convey belt on the basis of preliminary ejection data for the preliminary ejection such that, until a specific length of time has passed from the ejection of the liquid from the ejection openings onto the preliminary ejection region, liquid is landed on a position in the preliminary ejection region in current ejection, which position does not overlap any of at least one position of the liquid landed after the ejection of the liquid from which the specific length of time has passed, wherein each of the at least one head is formed by a line head having the ejection face elongated in a main scanning direction perpendicular to the conveying direction, the ejection opening being arranged in the main scanning direction, wherein one of the at least one preliminary ejection region faces the ejection face within a preliminary ejection period, the one preliminary ejection region having a plurality of ejection areas each elongated in the main scanning direction, wherein the preliminary ejection period is a period in which the one preliminary ejection region faces the ejection face, wherein, where the preliminary ejection period appears n times at intervals within the specific length of time from a start of the ejection of the liquid onto the one preliminary ejection region in the preliminary ejection, the controller controls the head and the convey belt such that the liquid is ejected within each of the preliminary ejection periods onto a corresponding one of the ejection areas and such that ejection areas for the respective first to nth preliminary ejections periods are arranged in parallel in the conveying direction, wherein the at least one head is a plurality of heads arranged in the conveying direction, wherein the controller is configured to control the plurality of heads and the convey belt such that the ejection areas for the respective first to nth preliminary ejection periods for each of the plurality of heads are arranged parallel in the conveying direction in the one preliminary ejection region and such that the ejection areas for the respective first to nth preliminary ejection periods and for each of the plurality of heads are arranged in parallel in the conveying direction, wherein the support region is disposed on an upstream side of the preliminary ejection region in the conveying direction, wherein the plurality of heads are configured to respectively eject liquids having respective different lightnesses of color, and wherein the controller is configured to control the plurality of heads and the convey belt such that the ejection areas for the respective first to nth preliminary ejection periods and for each of the plurality of heads are arranged from a downstream side in the conveying direction in order of increasing lightness of color.

13. The liquid ejection apparatus according to claim 10, wherein the controller is configured to control the head and the convey belt such that each of the ejection areas for the respective n preliminary ejection periods and for the head has a width of a single line.

14. The liquid ejection apparatus according to claim 10, wherein the controller is configured to control the head and the convey belt such that each of the ejection areas for the respective n preliminary ejection periods and for the head has a width of two or more lines.

15. The liquid ejection apparatus according to claim 1, wherein the preliminary ejection region faces the ejection face within a preliminary ejection period that is a period in which the one preliminary ejection region faces the ejection face, and wherein the preliminary ejection data is produced by selecting at least one of the ejection openings from which the liquid is ejected within the preliminary ejection period, on the basis of an ejection history within periods immediately before and after the preliminary ejection period.

16. A storage medium storing a program used for a liquid ejection apparatus, the apparatus comprising:

at least one head each having an ejection face which has a plurality of ejection openings opened therein for ejecting liquid onto a recording medium, the at least one head comprising at least one first head having a first ejection face as the ejection face and the first ejection face having a plurality of first ejection openings formed therein as the plurality of ejection opening for ejecting recording liquid onto the recording medium; and a convey belt which has a support region and at least one preliminary ejection region each provided on a face of the convey belt and which is configured to convey the recording medium in a conveying direction parallel to the ejection face by moving the face of the convey belt in a state in which the face faces the ejection face, wherein the support region is a region for supporting the recording medium, wherein the preliminary ejection region is a region onto which the liquid is ejected from the ejection openings in preliminary ejection, and wherein the preliminary ejection is ejection not contributing to image recording, wherein the program is operable to control the head and the convey belt on the basis of preliminary ejection data for the preliminary ejection such that, until a specific length of time has passed from a certain ejection of the recording liquid from one of the ejection openings onto the preliminary ejection region, a plurality of recording liquids ejected from the one of the ejection openings in the preliminary ejection are landed on positions in the preliminary ejection region that do not overlap with each other and such that, after the specific length of time has passed from the certain ejection of the recording liquid, each of at least one recording liquid ejected from the one of the ejection openings in a current ejection is landed onto a corresponding one of the plurality of recording liquids that landed the specific length of time before the current ejection of the at least one recording liquid, and wherein the controller is configured to control the head and the convey belt such that the plurality of recording liquids receives the recording liquid ejected from the one of the ejection openings the specific length of time after the certain ejection in order of length of time the plurality of recording liquids have been landed, starting with the greatest length of time.

17. The storage medium storing according to claim 16, wherein the at least one head comprises a second head having a second ejection face as the ejection face, the second ejection face having a plurality of second ejection openings formed therein, as the plurality of ejection openings for ejecting transparent treatment liquid onto the recording medium, wherein the support region of the convey belt is disposed on an upstream side of the preliminary ejection region in the conveying direction, the convey belt being configured to convey the recording medium in the conveying direction parallel to the first ejection face and the second ejection face by moving the face of the convey belt in a state in which the face faces the first ejection face and the second ejection face, and wherein the program is operable to control the first head, the second head, and the convey belt on the basis of the preliminary ejection data such that the recording liquid is ejected from the plurality of first ejection openings and landed on the preliminary ejection region, and thereafter the treatment liquid is ejected to be landed on a position in the preliminary ejection region, which position is located on an upstream side of a position on which the recording liquid has been landed, in the conveying direction.

* * * * *